US011713514B2

(12) United States Patent
Riemer et al.

(10) Patent No.: US 11,713,514 B2
(45) Date of Patent: Aug. 1, 2023

(54) SYSTEMS FOR ELECTROPLATING AND METHODS OF USE THEREOF

(71) Applicant: Hutchinson Technology Incorporated, Hutchinson, MN (US)

(72) Inventors: Douglas P. Riemer, Waconia, MN (US); Stephen P. Toperzer, Altoona, WI (US); Donovan D. Turvold, Cosmos, MN (US); Christopher R. Rosenau, Eau Claire, WI (US); Dylan S. Johnson, Eau Claire, WI (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 0 days.

(21) Appl. No.: 16/987,105

(22) Filed: Aug. 6, 2020

(65) Prior Publication Data

US 2021/0040640 A1 Feb. 11, 2021

Related U.S. Application Data

(60) Provisional application No. 62/884,641, filed on Aug. 8, 2019.

(51) Int. Cl.

| | |
|---|---|
| ***C25D 17/04*** | (2006.01) |
| ***C25D 3/22*** | (2006.01) |
| ***C25D 3/38*** | (2006.01) |

(52) U.S. Cl.

CPC ..... *C25D 17/04* (2013.01); *C25D 3/22* (2013.01); *C25D 3/38* (2013.01)

(58) Field of Classification Search

None

See application file for complete search history.

(56) References Cited

U.S. PATENT DOCUMENTS

| | | | | |
|---|---|---|---|---|
| 2,330,562 A * | 9/1943 | Drummond | ..... | C25F 7/00 204/210 |
| 6,071,400 A * | 6/2000 | Schroder | ..... | H05K 3/07 205/687 |
| 2006/0201817 A1* | 9/2006 | Guggemos | ..... | C25D 17/005 204/198 |

FOREIGN PATENT DOCUMENTS

| | | | | |
|---|---|---|---|---|
| KR | 1020180071567 A * | 6/2018 | ..... | C25D 7/0621 |
| WO | 2009/146773 A1 | 12/2009 | | |

* cited by examiner

*Primary Examiner* — Louis J Rufo

(74) *Attorney, Agent, or Firm* — DLA Piper LLP (US)

(57) ABSTRACT

A system for electroplating a web of conductive material with a source material comprises a transport mechanism, an electrical contact, a plating bath, and at least one nozzle. The transport mechanism transports the web through the system. The electrical contact electrically engages the web to cause current to flow into the web. The plating bath contains a volume of an electrically conductive liquid contain ions of the source material. The nozzle is configured to flow a low electrical conductivity fluid onto the web. A portion of the web is immersed in the electrically conductive liquid. The current flowing in the web causes the ions of the source material in the electrically conductive liquid to attach to a surface of the portion of the web.

31 Claims, 15 Drawing Sheets

SYSTEMS FOR ELECTROPLATING AND METHODS OF USE THEREOF

RELATED APPLICATIONS

This application claims the benefit of, and priority to, U.S. Provisional Patent Application Ser. No. 62/884,641, filed Aug. 8, 2019, titled SYSTEMS FOR ELECTROPLATING AND METHODS OF USE THEREOF, the entire disclosure of which is hereby incorporated by reference.

TECHNICAL FIELD

The present disclosure relates to systems and methods for electroplating, more specifically, the present disclosure relates to a method and a system for electroplating with an improved electrical contact.

BACKGROUND

Electroplating is a method by which an object is coated or plated with molecules of a source material. For example, copper ions can be plated onto a wide variety of different objects. Electroplating involves electrically coupling both the object to be plated and the source material to an electrical power source and immersing both the object to be plated and the source material in an electrically conductive liquid. The thickness and consistency of the layer of molecules to be plated determines the amount of current required. Various difficulties exist in ensuring good electrical contact between the objected to be plated, and an electrical contact or electrode that is coupled to the electrical power source, which can lead to uneven coating and/or weaknesses in the coating layer. Aspects of the present disclosure overcome these difficulties and address other needs.

SUMMARY

According to some implementations of the present disclosure, a system for electroplating a web of conductive material with a source material comprises a frame; a transport mechanism coupled to the frame, the transport mechanism being configured to advance the web through the system; an electrical brush-contact coupled to the frame, the electrical brush-contact configured to electrically engage the web thereby causing current to flow from the electrical brush-contact into the web; a plating bath containing a volume of an electrically conductive liquid therein, the electrically conductive liquid including a plurality of ions of the source material, wherein the transport mechanism is configured to transport the web through the plating bath such that a portion of the web is disposed in the electrically conductive liquid, the current flowing into web causing at least a portion of the plurality of ions of the source material to attach to a surface of the portion of web disposed in the electrically conductive liquid; and at least one nozzle coupled to the frame, the nozzle being configured to flow a low electrical conductivity fluid onto the surface of the portion of the web responsive to the transport mechanism transporting the portion of the web out of the plating bath, the low electrical conductivity fluid removing residual electrically conductive liquid disposed on the web.

According to other implementations of the present disclosure, a method of electroplating a web of conductive material with a source material comprises translating the web such that a first portion of the web is transported to a plating bath containing an electrically conductive liquid, the electrically conductive liquid containing a plurality of ions of the source material, the first portion of the web being immersed in the electrically conductive liquid; translating the web such that the first portion of the web is transported out of the plating bath to a nozzle and such that a second adjacent portion of the web is transported to the plating bath and immersed in the electrically conductive liquid, the first portion of the web retaining an amount of the electrically conductive liquid on a surface of the first portion of the web responsive to being translated out of the plating bath; flowing, using the nozzle, a low electrical conductivity fluid onto the surface of the first portion of the web responsive to the first portion of the web being translated out of the plating bath, the low electrical conductivity fluid removing at least a portion of the retained amount of electrically conductive liquid from the surface of the first portion of the web; translating the web such that the first portion of the web is transporting to an electrical contact, such that the second portion of the web is transporting out of the plating bath to the nozzle, and such that a third adjacent portion of the web is transported to the plating bath and immersed in the electrically conductive liquid; and electrically engaging the first portion of the web with the electrical contact to thereby cause current to flow into the web, the current flowing into the web causing at least a portion of the plurality of ions of the source material to attach to a surface of the third portion of the web immersed in the electrically conductive liquid.

According to additional implementations of the present disclosure, a system for electroplating a web of conductive material with a source material comprises a frame; a plating bath including a volume of an electrically conductive liquid having a first portion of the web disposed therein such that at least a surface of the first portion of the web is immersed in the volume of the electrically conductive liquid, the electrically conductive liquid including a plurality of ions of the source material; at least one nozzle coupled to the frame and disposed adjacent to the plating cell, the nozzle being configured to flow a low electrical conductivity fluid onto a surface of an adjacent second portion of the web, the low electrical conductivity fluid removing an amount of the electrically conductive liquid from the surface of the second portion of the web; an electrical contact mounted to a frame, the electrical contact being disposed adjacent to the nozzle such that the nozzle is disposed between the plating bath and the electrical contact, the electrical contact being configured to electrically engage an adjacent third portion of the web thereby causing current to flow through the web from the third portion of the web to the first portion of the web, the current flowing through the web causing at least a portion of the plurality of ions of the source material to attach to the surface of the first portion of the web disposed in the electrically conductive fluid; and at least one pair of rollers disposed between the plating bath and the nozzle, the at least one pair of rollers including a top roller and a bottom roller spaced apart such that the web of conductive material is disposed between the top roller and the bottom roller, wherein rotation of the at least one pair of rollers is configured to advance the web of conductive material through the system from the plating bath, past the fluid source, and to the electrical contact, such that a surface of the web slides past the at least one electrical contact.

According to further aspects of the present disclosure, a system for electroplating a source material onto a web comprises a frame; a transport mechanism coupled to the frame and being configured to transport the web through the system; an electrical contact coupled to the frame and being configured to electrically engage the web, thereby causing current to flow from the electrical contact into the web; a plating bath containing a volume of an electrically conductive liquid therein, the electrically conductive liquid including a plurality of ions of the source material, the transport mechanism being configured to transport the web such that (i) a portion of the web is moved through and in direct contact with the electrically conductive liquid of the plating bath and (ii) the current flowing into the web causes at least a portion of the plurality of ions of the source material to attach to a surface of the portion of the web being moved through and in direct contact with the electrically conductive liquid; and at least one nozzle coupled to the frame and configured to flow a low electrical conductivity fluid onto at least a portion of the surface of the portion of the web responsive to the transport mechanism transporting the portion of the web out of the plating bath.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1:
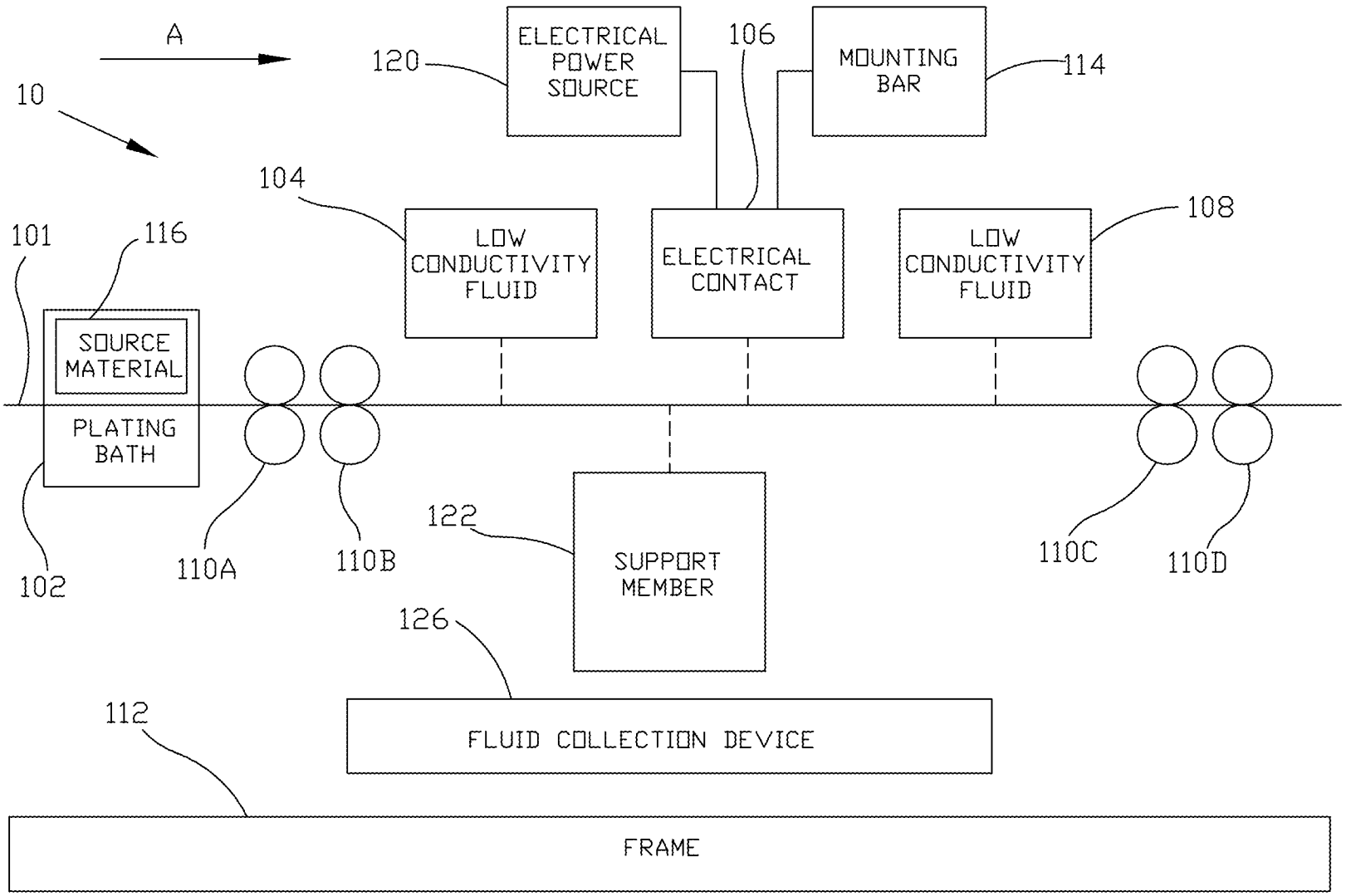
FIG. 1 illustrates a block diagram of a system for electroplating a web of conductive material according to some implementations of the present disclosure.

While the present disclosure is susceptible to various modifications and alternative forms, specific implementations and embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Electroplating is a method of coating the surface of an object with molecules of a different material. The method generally includes forming a path for electric current to flow using both the object that is to be plated (or coated) as one electrode, and a source of the different material as a second electrode. Electroplating is often used to plate the surface of one metal with molecules of a different metal. For example, silver wires can be plated with chloride to form silver chloride electrodes. In another example, pennies are formed by plating a layer of copper onto a piece of zinc. In a basic electroplating system, the object to be plated is connected to the negative terminal of an electrical power source, while the source material is connected to the positive terminal of the electrical power source to plate when depositing a material that is a cation. The object to be plated is thus the cathode, while the source material is the anode. When depositing a material that is an anion, such as chloride on silver, the object to be plated is connected to the positive terminal, while the source material, such as a bath, is connected to the negative terminal of the electrical power source. For other embodiments, a dimensionally stable anode is used and ions in the bath provide the source material for plating. The object to be plated and the source material are both immersed in a liquid bath, or otherwise fluidly connected via a liquid bath. The liquid bath is generally formed of an electrolyte solution containing ions of the source material (e.g., copper, gold, nickel). Further, electroetching of a metal can be performed using techniques including those describe herein with a positive terminal connected to the object to be etched and a negative terminal of the electrical power source connected to the liquid bath configured as a electroetching bath with an etchant, such as a sulfuric acid bath. Moreover, the power source used for electroplating or electroetching can be direct current (DC), alternating current (AC), pulsed, and pulsed reversed. The techniques described herein are also applicable to electrical polishing techniques that use liquid bath configured as a electropolishing bath.

When the circuit between the cathode and the anode is completed, electrons flow from the anode (the source material) to the cathode (the object to the plated) via the electrical connection to the electrical power source. The atoms of the source material are oxidized by the electrons leaving the source material and can then dissolve into the solution. These positively charged ions are electrostatically attracted to the cathode and can travel through the solution toward the cathode. The electrons that leave the anode flow through the electrical power source and into the cathode. The positively charged ions are then reduced at the cathode by gaining electrons to return to a neutral electrical charge and are thus plated onto the surface of the cathode. In this manner, ions of the source material (the anode) are deposited to onto the surface of the object that is being plated (the cathode).

A wide variety of objects can be plated using various types of electroplating systems. Examples of materials that can be plated onto an object include, but are not limited to, copper, nickel, gold, platinum, chrome, iron, and zinc. In industrial applications, one or more objects to be plated are attached to a long thin sheet of conductive material known as a web. The width of the web is defined as the dimension of the web extending perpendicular to the direction of transport of the web through the system. The rate of source material that is plated on to object attached to the web is based in part on the amount of current that flows through the web, and how long the current is applied to the web. For example, a relatively thicker layer of the source material will be plated onto the web if relatively more current is applied and/or if the current is applied for a relatively longer amount of time. Thus, by controlling the electrical characteristics and/or parameters of the electrical power source, the amount of source material plated onto the web can be controlled.

Figure 2:
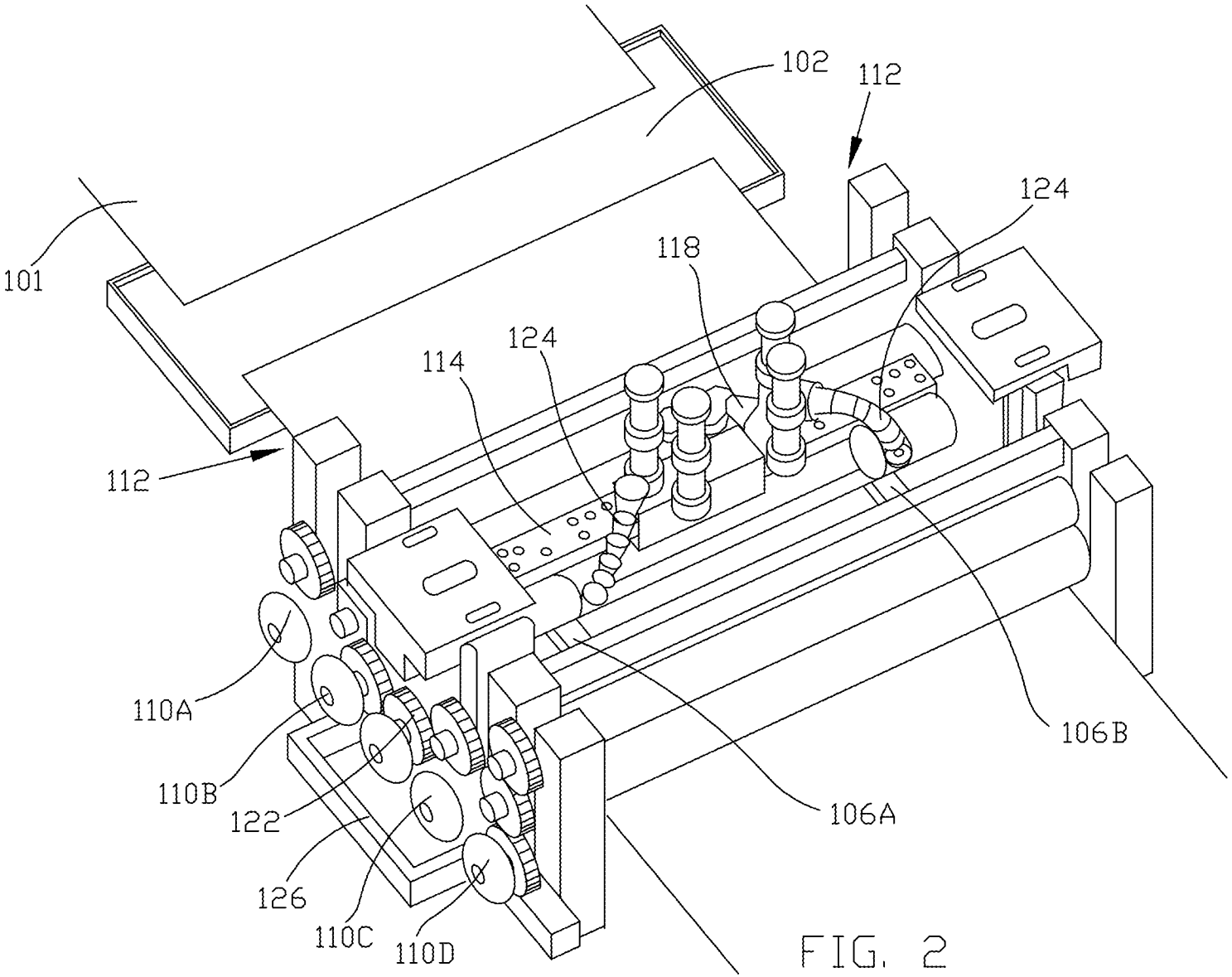
FIG. 2 illustrates a perspective view of an electrical contact according to some implementations of the present disclosure.
Figure 3:
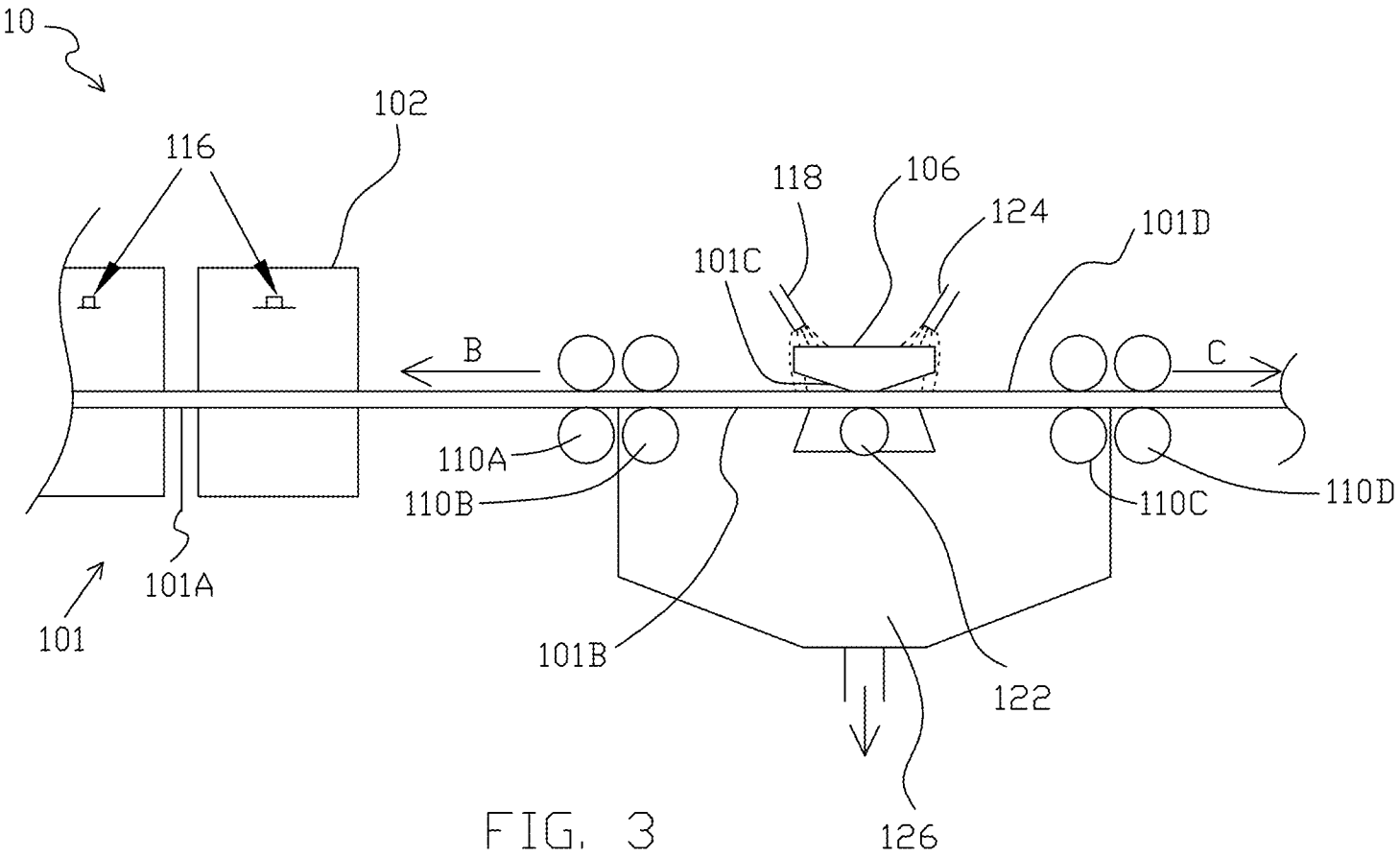
FIG. 3 illustrates a cross-sectional view of the system including an electrical contact according to some implementations of the present disclosure.

Referring now to FIGS. 1-3, a system 10 for plating a web 101 of conductive material includes a plating bath 102 containing a volume of an electrically conductive liquid (such as an electrolyte solution) that include ions to be deposited on an object, a first low electrical conductivity fluid area 104, an electrical contact 106, and a low electrical conductivity fluid area 108. The system 10 can also include a transport mechanism that comprises a first transport mechanism portion 110A, a second transport mechanism portion 110B, a third transport mechanism portion 110C, and a fourth transport mechanism portion 110D that are configured to transport the web 101 through the system 10 in the direction of arrow A, which is parallel to the longitudinal axis of the system. System 10 can generally be part of a larger overall assembly line that includes a variety of different equipment for performing different tasks on/with an object disposed on web 101 including one or more plating bathes and one or more electrical contacts. The system 10 can be a subset of the overall assembly line where an object disposed on the web 101 is plated. As best shown in FIG. 2, the system 10 includes a frame 112 that supports and/or couples to the components of the system 10. For example, each transport mechanism portion 110A-110D can be coupled to slots in the frame 112. Further, electrical contact 106 (which can include electrical contacts 106A and 106B as shown in FIG. 2) can be coupled to a mounting bar 114, which is then coupled to the frame 112. The frame 112 can be a single unitary piece or can include multiple separate components that are removably or permanently attached to each other. At various times throughout processing, specific portions of the web 101 are configured to be disposed at or near each component of the system 10. As best shown in FIG. 3, for example, in some implementations, a first portion 101A of the web 101 is disposed within the plating bath 102 such that the object disposed on the web is at least partially immersed in the electrically conductive liquid, an adjacent second portion 101B of the web 101 is disposed in the first low electrical conductivity fluid area 104, an adjacent third portion 101C of the web 101 is disposed at the electrical contact 106, and an adjacent fourth portion 101D of the web 101 is disposed in the second low electrical conductivity fluid area 108. Thus, in such implementations, the electrical contact 106 is configured to electrically engage the third portion 101C of the web 101 when the first portion 101A of the web 101 is immersed in the electrically conductive liquid of the plating bath 102.

The plating bath 102 contains a volume of an electrically conductive liquid, for example an electrolyte solution containing ions of the material (e.g., copper) that is to be plated onto one or more objects disposed on the web 101. The plating bath 102 also includes the source material 116, which can be, for example, a sample of copper or other metal. The plating bath 102 is configured such that both the source material 116 and any portion of one or more objects disposed on the web 101 are immersed in the electrically conductive liquid of the plating bath 102, or are otherwise in fluid communication with each other via the electrically conductive liquid.

The first transport mechanism portion 110A is disposed between the plating bath 102 and the first low electrical conductivity fluid area 104. The first transport mechanism portion 110A is configured to assist in transporting the web 101 through the system 10. In some implementations, each of the transport mechanism portions 110A-110D includes a top roller and a bottom roller arranged such that when the web 101 is being transported through the system 10, the web 101 is disposed between the top roller and the bottom roller. The top roller and the bottom roller are spaced apart such that the web 101 fits therebetween and both the top roller and the bottom roller contact the web 101. The top roller and the bottom roller generally have a circular cross-section and can have a width extending in the same direction as the width of the web 101. In this manner, the width of the top roller and the bottom roller is perpendicular to the direction of transport (arrow A) of the web 101 through the system 10.

In some implementations, the width of the top roller and the width of the bottom roller are generally equal to the width of the web 101. Thus, the top roller makes contact with the top side of the web 101 in a line extending across the width of the web 101, perpendicular to the direction of transport of the web 101 through the system 10. The bottom roller makes contact with the underside of the web 101 in a line extending across the width of the web 101, perpendicular to the direction of transport of the web 101 through the system 10. In other implementations, the top roller and the bottom roller have varying widths relative to the width of the web 101. The top roller and the bottom roller are each configured to rotate such that friction between the top and bottom rollers and the web 101 causes the web 101 to advance through the system 10 in the direction of arrow A. In this implementation, as a portion of the web 101 emerges from the plating bath 102, some amount of the electrically conductive liquid remains or is otherwise retained on the surface of the portion of the web 101. Because the top roller contacts the surface of the web 101, the top roller comes into contact with at least a portion of the retained amount of the electrically conductive liquid and forces this portion of the electrically conductive liquid off of the surface of the web 101. Thus, the first transport mechanism 110A can remove some or all of the retained amount of the electrically conductive liquid from the surface of this portion of the web 101 and the portion of the object disposed on this portion of the web 101. In another implementation, the first transport mechanism portion 110A includes a mechanical gripper or other similar device that is able to physically engage the web 101 and cause the web 101 to advance through the system 10.

The second transport mechanism portion 110B can be disposed adjacent to the first transport mechanism 110A such that after a portion of the web 101 emerges from the first transport mechanism portion 110B, that portion of the web 101 then passes between the top roller and the bottom roller of the second transport mechanism portion 110B. The top roller and the bottom roller of the second transport mechanism portion 110B rotate to advance the web 101 through the system 10. The second transport mechanism portion 110B can also assist in removing any residual electrically conductive liquid from the surface of a portion of the web 101 a portion of the object disposed on this portion of the web 101 prior to electrically engaging that portion of the web 101.

After a portion of the web passes through the second transport mechanism portion 110B, that portion of the web is transported through the first low electrical conductivity fluid area 104, which is disposed adjacent to the second transport mechanism portion 110B. As the web 101 passes through the first low electrical conductivity fluid area 104, a low electrical conductivity fluid is sprayed, flowed, directed or otherwise deposited onto the surface of this portion of the web 101 that just emerged from the first transport mechanism portion 110A. The low electrical conductivity fluid that is sprayed onto the surface of the web 101 assists in rinsing off or otherwise removing some or all of residual electrically conductive liquid that may still be disposed on the surface of the web 101 after passing through the first transport mechanism portion 110A. In some implementations, the low electrical conductivity fluid is deionized water. In other implementations, the low electrical conductivity fluid includes, but is not limited to air, reverse osmosis water, alcohols such as isopropyl alcohol, distilled water, and low electrical conductivity fluids.

In some implementations, the first low electrical conductivity fluid area 104 includes one or more nozzles 118 (for example, as shown in FIG. 2) that are in fluid communication with a source of the low electrical conductivity fluid, such as a tank or other storage device. The one or more nozzles 118 can be coupled to the frame 112. According to some implementations, the orientation and/or location of the one or more nozzles 118 are adjustable such that the low electrical conductivity fluid can be sprayed or otherwise emitted from the nozzles 118 and flowed onto any portion of the web 101 along the width of the web 101 that is passing underneath or adjacent to the nozzles 118. The nozzles 118 can be configured to continuously or periodically spray the low electrical conductivity fluid onto the web 101. The nozzles 118 can be positioned at a variety of locations and in a variety of orientations so as to emit the low electrical conductivity fluid at a desired location relative to the electrical contact 106.

The low electrical conductivity fluid being flowed onto the surface of the web 101 has two purposes according to some implementations. The first purpose is to rinse off residual electrically conductive liquid from the surface of the portion of the web 101 and the object disposed on this portion of the web 101 passing underneath the first low electrical conductivity fluid area 104 after that portion of the web 101 passes through the first transport mechanism portion 110A. While the first transport mechanism portion 110A can assist in removing some electrically conductive liquid from the surface of that portion of the web 101, the low electrical conductivity fluid flowed onto the surface of the web 101 removes substantially all of the remaining electrically conductive liquid from that portion of the web 101 so as to greatly decrease the electrical conductivity of any liquid that remains on the surface of that portion of the web 101 and any object disposed thereon. This ensures that when this portion of the web 101 is electrically engaged by the electrical contact 106, electric current flows within the web 101 to the portion of the web 101 that is currently in the plating bath 102. Removal of the electrically conductive liquid helps to ensure the current from the electrical contact 106 flows within the web 101 and not bypassing the web 101 by flowing through the electrically conductive liquid. This ensures that the desired current density is delivered from the electrical contact 106 and to the plating site.

If the surface of the portion of the web 101 that is being electrically engaged by the electrical contact 106 has a sufficient amount of electrical conductive liquid remaining thereon, some amount of the source material 116 that was plated onto the surface of that portion of the web 101 when that portion of the web 101 was in the plating bath 102 can inadvertently be removed from the surface of that portion of the web 101 and be plated onto the electrical contact 106 itself. Removing this inadvertently-plated material from the electrical contact 106 requires additional processing steps, which are often time consuming and inefficient. By flowing low electrical conductivity fluid onto the surface of the portion of the web 101 after that portion exits the plating bath 102 and before that portion is electrically engaged by the electrical contact 106, this "reverse plating" effect can be substantially reduced, or even eliminated. The second purpose of the low electrical conductivity fluid is to cool the surface of the web 101. When the electrical contact 106 electrically engages the web 101, the current being injected can generate a large amount of thermal energy (e.g., heat) in the web 101. The low electrical conductivity fluid that is flowed into the surface of the web 101 by the first low electrical conductivity fluid area 104 helps to keep the web 101 cool and reduce the amount of heat generated by the contact between the electrical contact 106 and the web 101. Thus, removing the electrically conductive liquid and cooling the web 101 increases the life of the electrical contact 106 minimizing the costs of downtime to maintain the system. After being transported through the first low electrical conductivity area 104, the web is transported to the electrical contact 106. The electrical contact 106 can be coupled to a mounting bar 114, which can then be coupled to the frame 112. The electrical contact 106 is generally disposed above the web and is electrically coupled to an electrical power source 120. The electrical contact 106 is configured to electrically engage the portion of the web 101 that is passing underneath by physically contacting the web 101. This allows current to flow from the electrical contact 106 through at least a portion of the web 101. Generally, the current flows from the electrical contact 106, into the portion of the web 101 that is passing underneath the electrical contact 106, and through the web 101 to at least the portion of the web 101 that is currently immersed in the electrically conductive liquid of the plating bath 102. Because the source material 116 is also immersed in the electrically conductive liquid of the plating bath 102 and electrically coupled to the electrical power source 120, the current flowing through the web 101 causes ions of the source material 116 to attach to the surface of the portion of an object disposed on of the web 101 that is immersed in the electrically conductive liquid.

The electrical contact 106 is designed such the electrical resistance of the path of the current through the electrical contact 106 is generally equal to the electrical resistance of the path of the current through the web 101. By matching these resistances, the amount of resultant current flowing through the web 101 will generally be equal to the amount of current flowing through the electrical contact 106, which can easily be controlled. Thus, by matching the resistance of the electrical contact 106 to the resistance of the current path through the web 101, the amount of source material 116 plated onto the web 101 can be controlled. In some implementations, the electrical resistance of the electrical contact 106 is equal to the electrical resistance of the current path through the web 101. In other implementations, the electrical resistance of the electrical contact 106 is within a sufficient range above or below the electrical resistance of the current path through the web 101. Further, the electrical contact 106 is configured such that the current density across the portion of the web 101 immersed in the electrically conductive liquid is maintained within a range. Thus, the electrical contact 106 minimizes a voltage drop across the portion of the web 101 immersed in the plating bath. For some implementations, the current density at the electrical contact 106 can be in a range including 1 Ampere per centimeter$^2$ up to and including 100 Amperes per centimeter$^2$. However, other current densities outside this range at the electrical contact 106 can be used.

The electrical contact 106 can be coupled to the frame 112 or the mounting bar 114 using a biasing member, such as a spring. The biasing member is configured to compress responsive to the electrical contact 106 contacting the surface of the web 101. This reduces the downward force that is imparted onto the surface of the web 101 by the electrical contact 106, and causes the electrical contact 106 to be more responsive to variations in the web 101. For example, if the electrical contact 106 encounters any vertical features defined on the surface of the web 101, the biasing member will compress upon contact between the electrical contact 106 and the vertical features, thus reducing the force imparted onto the vertical features and decreasing the chances the features or the electrical contact 106 will be damaged. In addition, the biasing member ensures the electrical contact 106 returns to contact the web 101 for providing the desired current density for plating. Vertical features on the surface of the web 101 may include, but are not limited to, dielectric layers, plating masks, photoresist, drill holes, and plating faults such as extra material plated or other errors in the topology.

As best shown in FIG. 3, the system 10 also includes a support member 122 that is disposed adjacent to the web 101 such that the web 101 is sandwiched between the electrical contact 106 and the support member 122. The support member 122 contacts the underside of the web 101 to provide support and prevent the web 101 from deforming or otherwise bending downward as it passes underneath the electrical contact 106. The support member 122 can be formed from a lubricious or non-stick material (such as Teflon®) to allow the web 101 to easily slide past the support member 122 as it contacts the support member 122. In some implementations, the support member 122 includes a substantially flat surface having a width generally equal to the width of the web 101. In other implementations, the width of the flat surface of support member 122 is larger than the width of the web 101 to allow for the support member 122 to support the web 101 even if the web 101 shifts side to side during processing. The length of the support member 122 (e.g. the dimension of the support member 122 parallel to the direction of transport of the web 101 through the system 10) is generally equal to at least a corresponding dimension of the electrical contact 106. The support member 122 is thus configured to support the underside of the web 101 in an area corresponding to the area of contact between the electrical contact 106 and the top surface of the web 101. In some implementations, all portions of the electrical contact 106 are in equal contact pressure with the web 101. This ensures continuous contact between the electrical contact 106 and the web 101. According to some implementations the support member 122 is one or more rollers. In some implementations, the support member 122 has a width similar to the width of the electrical contact 106.

In some implementations, the support member 122 is a plate that is coupled to the frame 112 by at least one spring. The spring tension provided by the at least one spring biases the support member 122 towards the web 101. In some implementations, the spring tension also provides an upward force operable to bring the web 101 in contact with the electric contact 106. For example, if the electrical contact 106 encounters any vertical features defined on the surface of the web 101, the biasing member will expand upon contact between the electrical contact 106 and the vertical features, thus reducing the force imparted onto the vertical features and decreasing the chances the features or the electrical contact 106 will be damaged. In addition, the biasing member ensures the electrical contact 106 returns to contact the web 101 for providing the desired current density for plating.

After a portion of the web 101 is transported past the electrical contact 106, that portion of the web 101 is transported, according to some implementations, through a second low electrical conductivity fluid area 108, which is disposed adjacent to the electrical contact 106. The second low electrical conductivity fluid area 108 can be substantially similar to the first low electrical conductivity fluid area 104, and can include one or more nozzles 124 (for example, as shown in FIG. 2 and FIG. 3) that are in fluid communication with a source of the low electrical conductivity fluid, such as a tank or other storage device containing the low electrical conductivity fluid. In some implementations, the nozzles 124 of the second low electrical conductivity fluid area 108 may be in fluid communication with the same source of the low electrical conductivity fluid as the first low electrical conductivity fluid area 104. In other implementations, the nozzles 124 of the second low electrical conductivity fluid area 108 are in fluid communication with a separate source of the low electrical conductivity fluid.

The nozzles 124 of the second low electrical conductivity fluid area 108 are configured to flow or direct the low electrical conductivity fluid onto a portion of the surface of the web 101 that has passed by the electrical contact 106. The second low electrical conductivity fluid area 108 also helps to maintain the low electrical conductivity of any liquid disposed on the surface of the web 101 near the electrical contact 106, and also reduces the thermal energy (e.g. heat) generated in the web 101 by the electrical contact 106. Any number of nozzles 124 can be positioned at a variety of locations and in a variety of orientations so as to emit the low electrical conductivity fluid at a desired location relative to the electrical contact 106.

The system 10 can also include a fluid collection device 126. The fluid collection device 126 is generally disposed underneath the web 101 and is configured to collect any fluid that falls off of the web 101 as the web 101 passes through the system 10. For example, the fluid collection device 126 can be an elongated basin that spans the width of the web 101 and is sized to collect any electrically conductive liquid that may be rinsed off the web 101 as the web 101 passes through the first low electrical conductivity fluid area 104 or the second low electrical conductivity fluid area 108. The fluid collection device 126 also collects excess low electrical conductivity fluid that runs off the surface of the web 101. In some implementations, the fluid collection device 126 can recycle the collected low electrical conductivity fluid and return it to the first and second low electrical conductivity fluid areas 104, 108 so that the low electrical conductivity fluid may be used again.

After a portion of the web is transported through the second low electrical conductivity fluid area 108, that portion of the web travels through the third transport mechanism portion 110C and the fourth transport mechanism 110D. The third and fourth transport mechanism portions 110C and 110D can similar to the first and second transport mechanism portions 110A and 110B, and can each include a top roller and a bottom roller. The top rollers and the bottom rollers contact a respective side of the web, and rotations of the rollers causes the web 101 to advance through the system 10. After a portion of the web 101 exits the fourth transport mechanism portion 110D, that portion of the web 101 can enter a second plating bath (not shown), pass underneath a second electrical contact (not shown), enter into a new subset of the assembly line that that performs a different task on the one or more objects disposed on the web 101, and/or exit the assembly line entirely.

FIG. 3 illustrates a cross-sectional view of the system including an electrical contact according to some implementations of the present disclosure. During processing, a first portion 101A of the web 101 is located in the plating bath 102, a second portion 101B of the web 101 is located in the first low electrical conductivity fluid area 104, a third portion 101C of the web 101 is electrically engaged by the electrical contact 106 and is located between the electrical contact 106 and the support member 122, and a fourth portion 101D of the web 101 is located in the second low electrical conductivity fluid area 108. As the electrical contact 106 engages the third portion 101C of the web 101, current is caused to flow from the electrical contact 106 through the web 101. As illustrated by arrow B, current flows from the third portion 101C of the web 101 to the first portion 101A of the web 101 that is disposed in the plating bath 102, causing ions of the source material 116 to attach to the surface of the first portion 101A of the web 101. As shown by arrow C, some amount of current flows in the opposite direction within the web 101 as well.

Other implementations of the system 10 apart from what is illustrated in FIG. 1 are also contemplated. For example, some implementations of the system 10 can exclude the second transport mechanism portion 110B and the third transport mechanism portion 110C such that the electrical contact 106 is disposed directly between the first low electrical conductivity fluid area 104 and the second low electrical conductivity fluid area 108 (e.g., the system 10 can lack the second and third transport mechanism portions 110B and 110C of the transport mechanism 110). Other implementations of the system 10 include only one of the first low electrical conductivity fluid area 104 and the second low electrical conductivity fluid area 108, rather than both the first and second low electrical conductivity fluid areas 104,108. In another implementation, second transport mechanism portion 110B can be located directly adjacent to the first transport mechanism portion 110A such that the first low electrical conductivity fluid area 104 is located between the second transport mechanism portion 110B and the electrical contact 106. The third transport mechanism portion 110C can also be located directly adjacent to the fourth transport mechanism portion 110D such that the first low electrical conductivity fluid area 104 is located between the electrical contact 106 and the third transport mechanism portion 110C.

Figure 4B:
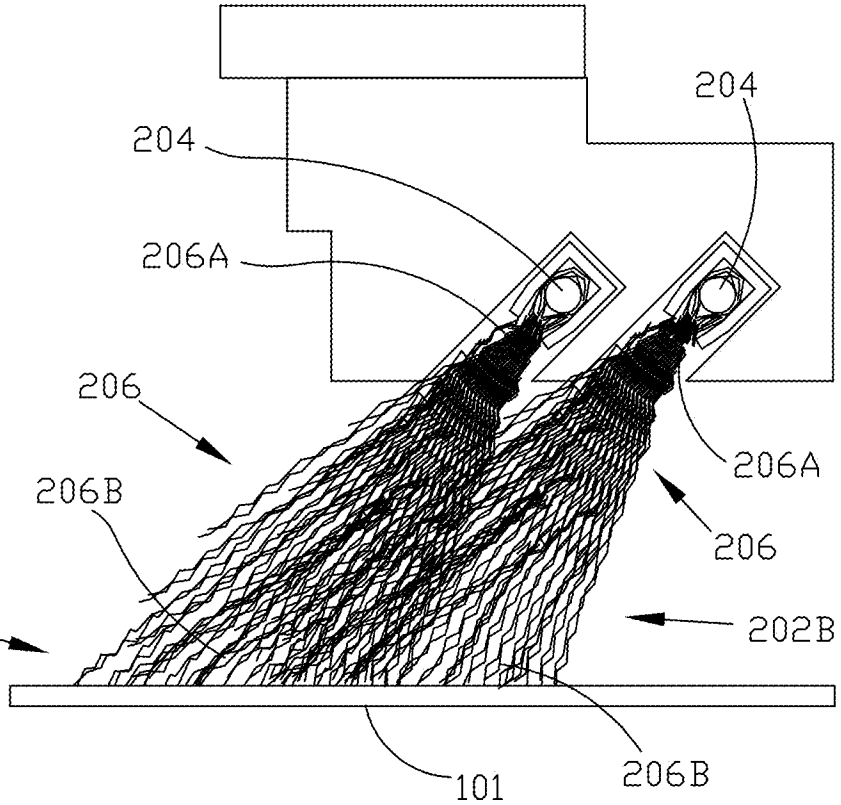
FIG. 4B illustrates a perspective view of another exemplary electrical contact for use with the system according to some implementations of the present disclosure.
Figure 4A:
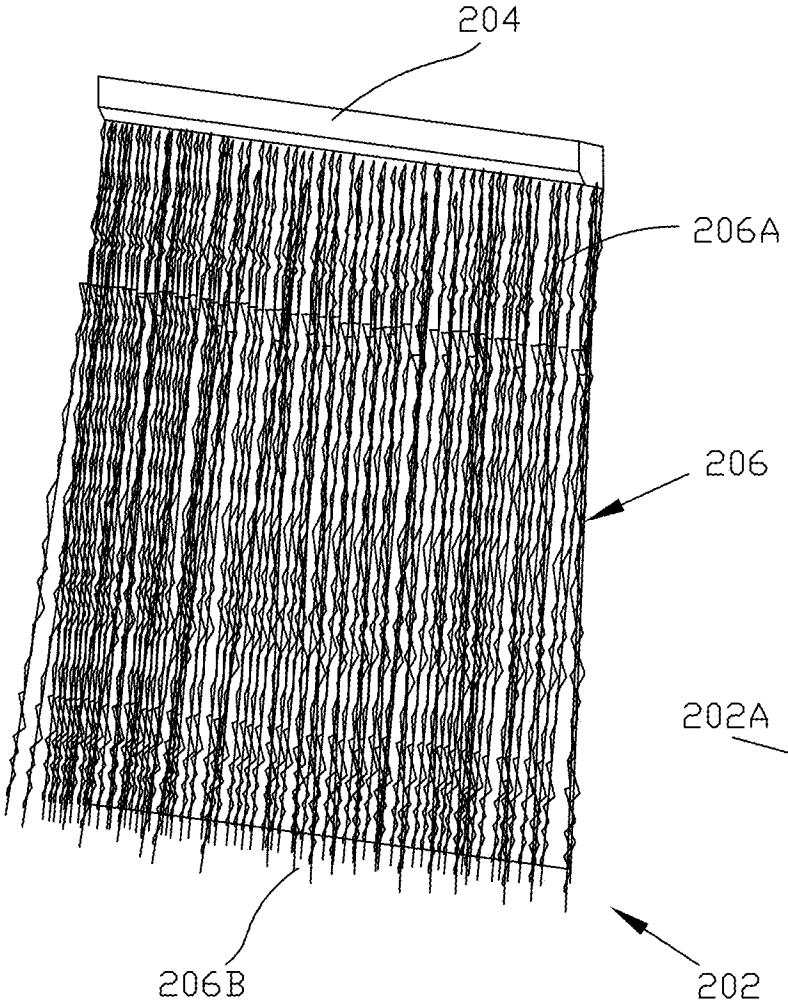
FIG. 4A illustrates a perspective view of an exemplary electrical contact for use with the system according to some implementations of the present disclosure.

In some implementations of the system 10, the electrical contact can be a brush contact for electrical plating, such as the electrical brush-contact 202 illustrated in FIG. 4A and FIG. 4B. The electrical brush-contact 202 includes a base 204 and a plurality of bristles 206. The proximal ends 206A of each of the plurality of bristles 206 are coupled to the base 204, while the distal ends 206B of each of the plurality of bristles extends outwardly away from the base 204 and are configured to contact the web 101 to thereby electrically engage the web 101. In some implementations of the disclosure, each of the distal ends 206B of each of the plurality of bristles are in equal contact pressure with the web 101. By using a plurality of bristles 206 that provide multiple distinct current paths between the electrical power source 120 and the web 101, the electrical brush-contact 202 is able to inject current into the web 101 across a broader area. This reduces the chances of damaging or burning the web 101 or the electrical brush contact 202 or having current arc from the contact to the web 101.

In some examples, the electrical brush contact 202 is coupled to a frame 212 such that the electrical contact 202 is fixed in its position, precluding any movement of the electrical contact 202. The electrical contact 202 may be fixed such that it is unable to move in any degree of freedom when in use. When the electrical contact is not in use, positional adjustments of the electrical contact 202 may be made in the x-y plane and/or in the x-z plane.

The base 204 can be coupled to the frame or to the mounting bar. In some implementations, the system 10 can include a first electrical brush-contact 202A and a second electrical brush-contact 202B coupled to the frame or the mounting bar such that the first electrical brush-contact 202A and the second electrical brush-contact 202B are directly adjacent to each other. As shown in FIG. 4B, the electrical brush-contact 202 can be coupled to the frame or the mounting bar such that at least a portion of the bristles 206 are disposed at an angle relative to the web 101. The bristles 206 have varying lengths such that the distal ends 206B of substantially all of the plurality of bristles 206 are coplanar and form or define a plane that is generally parallel to the surface of the web 101. The length of the bristles 206 are thus modified or otherwise configured to form a beveled bottom surface of the electrical brush-contact 202. The bottom surface of the electrical brush-contact 202 can have a generally rectangular shape having major axis parallel to the direction of transport of the web 101 through the system 10, and a minor axis perpendicular to the direction of transport of the web 101 through the system 10. In one implementation, the major axis is about two inches and the minor axis is about one quarter of an inch.

In some implementations, each of the plurality of bristles 206 is formed from substantially pure brass, a brass alloy, stainless steel or another composition including brass. In additional implementations, other electrically conductive metals can also be used, such as copper, zinc, or other suitable materials. The electrical brush-contact 202 can withstand between about 150 amps of current and about 250 amps of current. Thus, in some implementations, the system 10 is configured to cause between about 150 amps of current and between about 250 amps of current to flow through the web 101. In other implementations, the system 10 causes about 200 amps of current to flow through the web 101. In implementations of the system 10 having two or more electrical brush-contacts 202, the system 10 can be configured to cause between about 300 amps of current and about 500 amps of current, or about 400 amps of current, to flow through the web 101. In further implementations of the system 10 having any number of electrical brush-contacts 202, the system 10 can cause less than 150 amps of current to flow through the system 10 as may be desired to plate material having certain characteristic or at a desired plating rate onto the surface of an object disposed on the web 101.

As discussed above, the electrical contact 106 is configured such that the electrical resistance of the electrical contact 202 is approximately equal to the electrical resistance of the path of the current through the web 101. In the implementation illustrated in FIG. 4A and FIG. 4B, the electrical resistance of each of the plurality of bristles 206 is matched to the electrical resistance of the current path through the web 101. The electrical resistance of the current path from the electrical contact 202 to the portion of the web 101 that is disposed in the plating bath is given by the following equation:

$$R_{web} = \frac{\rho_{web} L_{contact-plating\ bath}}{A_{web}}$$

Here, $\rho_{web}$ is the resistivity of the material the web 101 is composed of, in units of ohm-meters, $L_{contact\text{-}plating\ bath}$ is the length of the current path from the electrical contact 202 to the plating bath, and $A_{web}$ is the cross-sectional area of the web 101, which is the thickness of the web 101 multiplied by the width of the web 101. The resistance of each bristle 206 of the electrical contact 202 is given by the following equation:

$$R_{web} = \frac{\rho_{bristle} L_{bristle}}{A_{bristle}}$$

Here, $\rho_{bristle}$ is the resistivity of each of the plurality of bristles 206. In some implementations, $\rho_{bristle}$ is the resistivity of brass, which can be between about $0.6\times10^{-7}$ ohm-meters and about $0.9\times10^{-7}$ ohm-meters. $L_{bristle}$ is the length of each bristle 206 from the proximal end 206A to the distal end 206B, while $A_{bristle}$ is cross-sectional area of each bristle 206. In some implementations, the length and the cross-sectional area of each bristle 206 is chosen such that each bristle 206 has an electrical resistance that matches the electrical resistance of the current path through the web 101, and also such that the bottom surface of the angled electrical brush-contact 202 is parallel to the surface of the web 101. In other implementations, the length and the cross-sectional area of each bristle 206 is chosen such that the electrical resistance of each bristle is within an acceptable range above or below the electrical resistance of the current path through the web 101, and also such that the bottom surface of the angled electrical brush-contact 202 is parallel to the surface of the web 101. For example, the electrical resistance of the bristles 206 may be less than an upper threshold electrical resistance that is greater than the electrical resistance of the current path, and greater than a lower threshold electrical resistance that is less than the electrical resistance of the current path. In this implementation, the electrical resistance of each of the bristles 206 is between the lower threshold electrical resistance and the upper threshold electrical resistance. For some implementations, the resistance of the electrical contact is configured such that it is on the same order of magnitude of the portion of the web in contact with the electrical contact. The resistance of the electrical contact, according to some implementations, is greater than or approximately equal to the resistance of the web along the portion of the web in contact with the electrical contact.

Figure 5B:
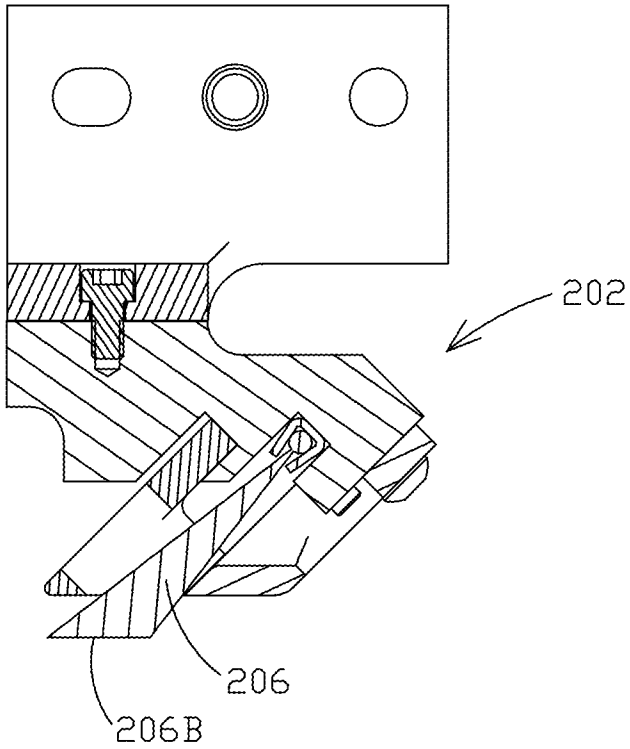
FIG. 5B illustrates a cross-sectional view of the exemplary electrical contact of FIG. 4A in a second orientation according to some implementations of the present disclosure.
Figure 5A:
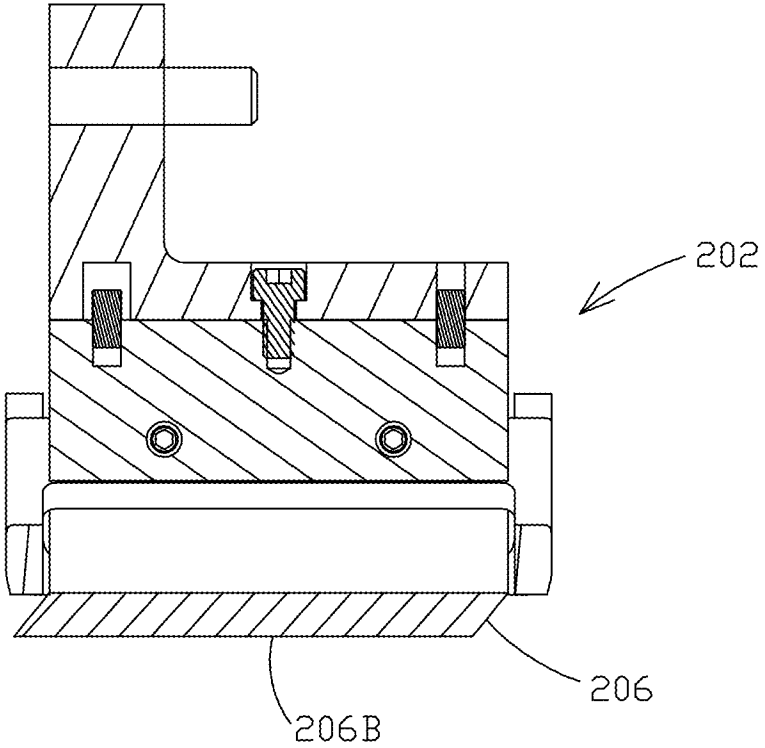
FIG. 5A illustrates a cross-sectional view of the exemplary electrical contact of FIG. 4A in a first orientation according to some implementations of the present disclosure.

In some implementations, the electrical brush-contact 202 is titled or angled relative to the surface of the web. FIGS. 5A and 5B illustrate cross-sections of the electrical brush-contact 202. FIG. 5A illustrates a cross-section of the electrical brush-contact 202 that is taken parallel to the direction of transport of the web through the system. FIG. 5B illustrates a cross-section of the electrical brush-contact 202 that is taken perpendicular to the direction of the transport of the web through the system.

As shown in FIG. 5A, the electrical brush-contact 202 can be tilted a first angle relative to the surface of the web. In some implementations, the first angle is between about thirty-five degrees and about fifty-five degrees. In another implementation, the first angle is about forty-five degrees. In a further implementation, the first angle is between about thirty degrees and about eighty degrees. When the electrical brush-contact 202 is coupled to the frame such that the bristles 206 are angled relative to the web, the bristles 206 of the electrical brush-contact 202 can be grouped in rows of bristles 206 that extend generally parallel to the direction of transport of the web through the system. The length of the bristles 206 in any given row of the electrical brush-contact 202 can be different from the length of the bristles 206 in all of the other rows of the electrical brush-contact 202. The lengths of the bristles 206 in all of the rows of the electrical brush-contact 202 are configured such that the distal ends 206B of all of the bristles 206 in every row are coplanar.

The angle that the electrical brush-contact is disposed at relative to the web also helps to improve the ability of the system to handle small variations of the location of the web as the web is transported through the system. As the web is transported through the system, the web can shift side-to-side slightly. This shifting can make it difficult to maintain proper alignment with the electrical brush-contact, and can result in damage to the web caused by the contacts. The angle helps to prevent entanglement of the web with the bristles as a result of the lateral motion of the web. By disposing the bristles at an angle relative to the surface of the web and then providing the distal ends of the bristles at varying lengths, the web is able to shift side-to-side without having the bristles 206 damage the web.

As is shown FIG. 5B, the electrical brush-contact 202 can also be tilted at a second angle relative to the web. In an implementation, the second angle is between about fifteen degrees and about thirty-five degrees. In another implementation, the second angle is about twenty-five degrees. In a further implementation, the second angle is between about thirty degrees and about eighty degrees. In an implementation, the angle that the electrical brush-contact 202 is tilted at relative to the surface of the web is a compound angle, e.g. the electrical brush-contact 202 is simultaneously tilted in a direction both parallel and perpendicular to the direction of transport of the web through the system.

Figure 6:
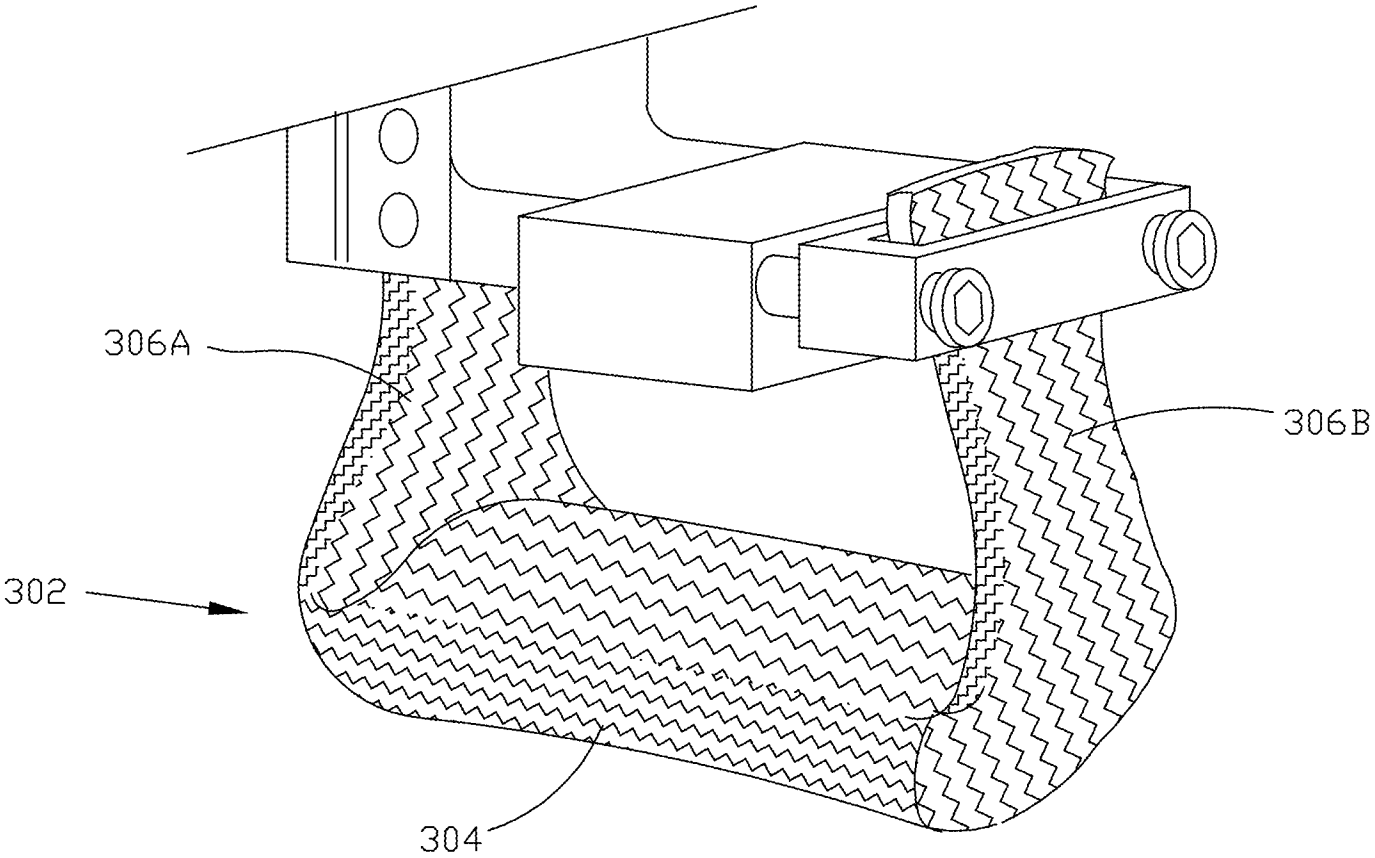
FIG. 6 illustrates a perspective view of an exemplary electrical contact for use with the system according to some implementations of the present disclosure.

Another implementation of the electrical contact is illustrated in FIG. 6. Electrical contact 302 includes a contact member 304 and legs 306A and 306B. Legs 306A and 306B are coupled to the frame or the mounting bar and project downward therefrom, while contact member 304 is configured to contact the surface of the web during operation to thereby electrically engage the web. In an implementation, electrical contact 302 comprises a braided copper material. This braided copper material is flexible to allow electrical contact 302 to flex in response to contact with the web to thereby reduce the force on the web. At least the underside of the contact member 304 can have rounded edges, which helps the electrical contact 302 maintain contact with the web when the web shifts from side to side during operation. In some implementations of the disclosure, an underside surface of the contact member 304 extending from leg 306A and leg 306B is in equal contact pressure with the web.

In some examples, electrical contact 302 is coupled to a frame such that the electrical contact 302 is fixed in its position, precluding any movement of the electrical contact 302. The electrical contact 302 may be fixed such that it is unable to move in any degree of freedom when in use. When the electrical contact 302 is not in use, positional adjustments of the electrical contact 302 may be made in the x-y plane and/or in the x-z plane.

Figure 7:
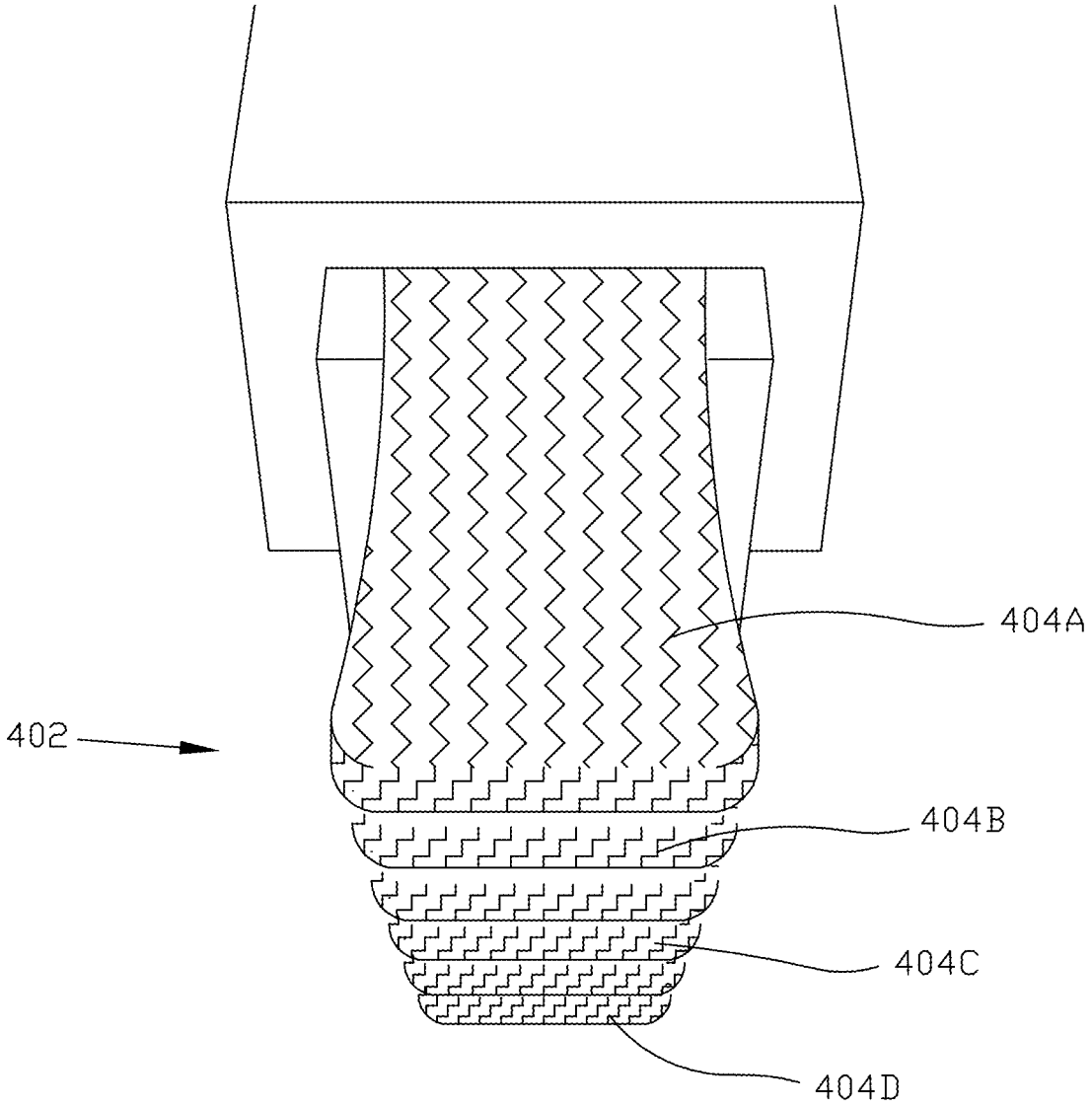
FIG. 7 illustrates a perspective view of an exemplary electrical contact for use with the system according to some implementations of the present disclosure.

A further implementation of the electrical contact is illustrated in FIG. 7. Electrical contact 402 includes a plurality of contact members 404A, 404B, 404C, and 404D that project downwardly from the frame towards the web. Contact members 404A-404D are configured to contact the web to thereby electrically engage the web, and generally comprise the same flexible, braided copper material as electrical contact 302. Each individual contact member 404 has a substantially rectangular bottom surface that contacts the web. In some implementations of the disclosure, each rectangular bottom surface of the contact members 404A-404D is in equal contact pressure with the web. The substantially rectangular bottom surface of each contact member 404 has a major axis parallel to the direction of transport of the web through the system, and a minor axis perpendicular to the direction of transport of the web through the system. However, the electrical contact 402 includes a sufficient number of contact members 404 such that the sum of the minor axes of all of the contact members 404 is greater than the major axis of any individual contact member 404.

In some examples, the electrical contact 402 is coupled to a frame such that the electrical contact 402 is fixed in its position, precluding any movement of the electrical contact 402. The electrical contact 402 may be fixed such that it is unable to move in any degree of freedom when in use. When the electrical contact 402 is not in use, positional adjustments of the electrical contact 402 may be made in the x-y plane and/or in the x-z plane.

Figure 8:
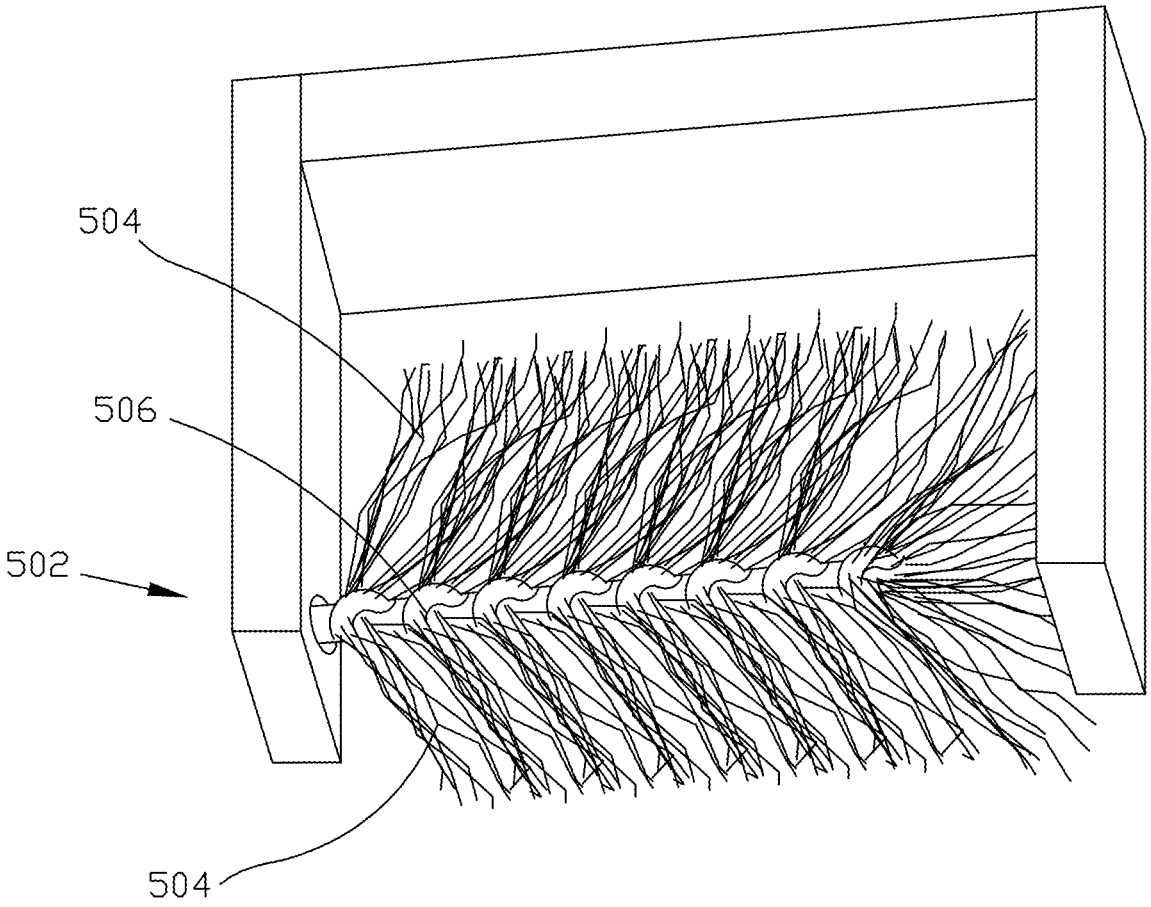
FIG. 8 illustrates a perspective view of an exemplary electrical contact for use with the system according to some implementations of the present disclosure.

An additional implementation of the electrical contact is illustrated in FIG. 8. Electrical contact 502 includes a plurality of bristles 504 emanating in a spiral pattern from a central core 506. The plurality of bristles 504 can be made up of brass, or another suitable electrically conductive material. The central core 506 of the electrical contact 502 is generally parallel to the direction of transport of the web through the system. In some implementations of the disclosure, each bristle of the plurality of bristles 504 is in equal contact pressure with the web.

Figure 9:
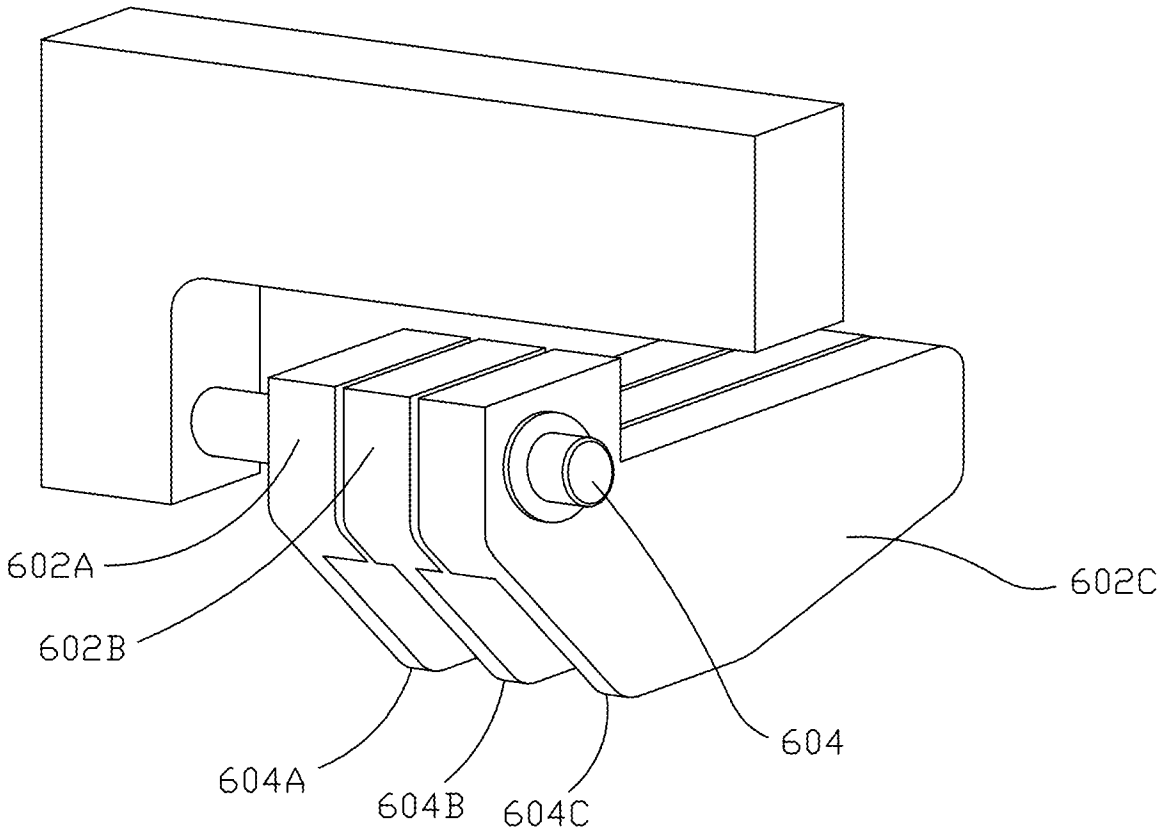
FIG. 9 illustrates a perspective view of an exemplary electrical contact for use with the system according to some implementations of the present disclosure.

An even further implementation of the electrical contact is illustrated in FIG. 9. The sliding, stationary electrical contact includes electrical contact members 602A, 602B, and 602C coupled to the frame in close proximity with each other. A connecting member 604 is configured to be received by each electrical contact member 602A-602C to thereby coupled the electrical contact members together. The contact member 604 has a length that is generally perpendicular to the direction of transport of the web through the system. Electrical contact members 602A, 602B, and, and 602C each comprise a generally solid piece of brass, stainless steel, copper, tungsten carbide, or other conductive materials, rather than bristles or braided conductive materials as in other implementations. Electrical contact members 602A, 602B, and 602C, according to some implementations, have a downward-pointing projection or finger 604A, 604B, 604C that is configured to contact the web and thereby electrically engage the web. In some implementations of the disclosure, each downward-pointing projection or finger 604A, 604B, 604C is in equal contact pressure with the web.

In some examples, the electrical contact 602 is coupled to a frame such that the electrical contact 602 is fixed in its position, precluding any movement of the electrical contact 602. The electrical contact 602 may be fixed such that it is unable to move in any degree of freedom when in use. When the electrical contact 602 is not in use, positional adjustments of the electrical contact 602 may be made in the x-y plane and/or in the x-z plane.

Further, the electrical contact is configured to go over vertical features, such as those described herein, and returns to contact the web without damaging the vertical features, according to some implementations. Contact members 602A, 602B, and 602C, by being located in close proximity to each other, allow for side-to-side movement of the web while ensuring that at least one of the contact members electrically engages the desired area on the web at all times. Some implementations of the sliding electrical contact include more than three electrical contact members.

Figure 10A:
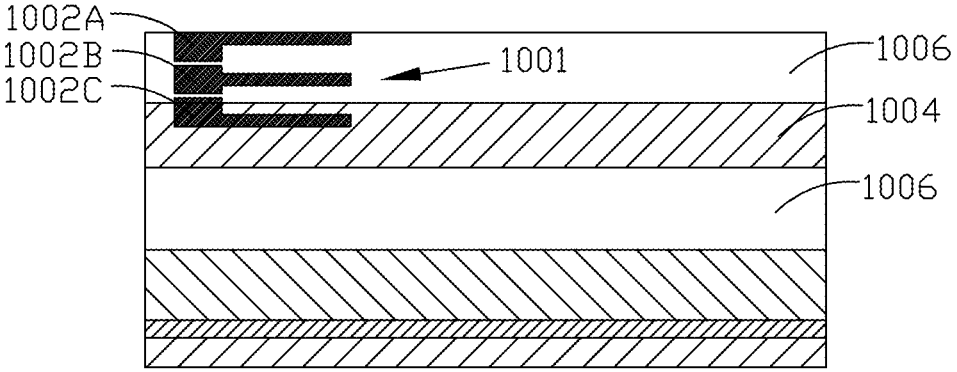
FIGS. 10A-C illustrates a perspective view of an exemplary electrical contact for use with the system according to some implementations of the present disclosure.
Figure 10B:
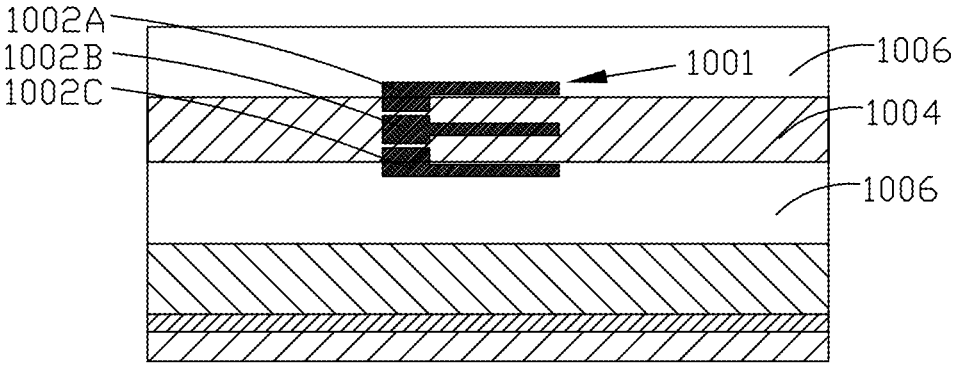
Figure 10C:
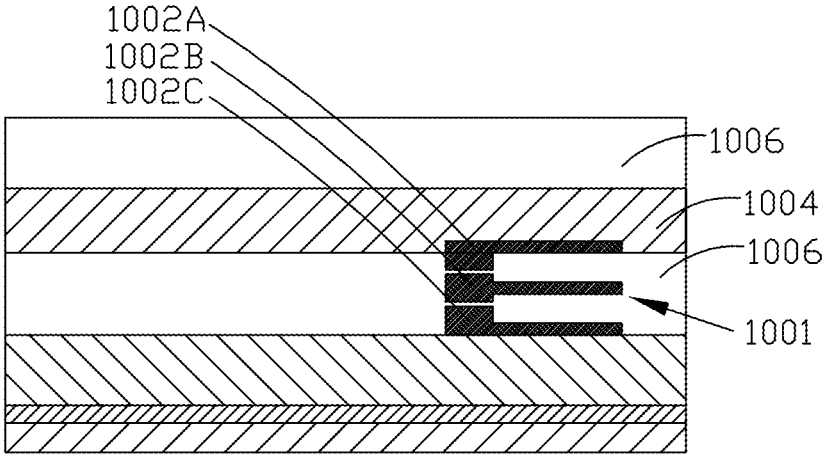

For some implementations, the electrical contact that includes electrical contact 1001 members 1002A, 1002B, and 1002C, similar to those described herein, is configured to electrically engage a conductive track 1004 formed on the web, such as that illustrated in FIGS. 10A, 10B, and 10C. Electrical contact 1001 members 1002A, 1002B, and 1002C are configured to improve the ability of the system to handle small variations of the location of the web as the web is transported through the system. As the web is transported through the system, the web can shift side-to-side slightly. This shifting can make it difficult to maintain proper alignment with the electrical contact 1001. As the web shifts from side-to-side, at least one of electrical contact 1001 members 1002A, 1002B, and 1002C maintain electrical engagement with conductive track 1004. In some implementations of the disclosure, each member 1002A, 1002B, and 1002C in engagement with the conductive track 1004 is in equal contact pressure with the conductive track 1004.

For some implementations, the electrical track 1004 is disposed on a non-conductive layer 1006 that is disposed on a web. Thus, the electrical track 1004 is electrically isolated from the web. The electrical track 1004 is disposed with relation to the web, such that the electrical track generally is formed to be parallel to the longitudinal axis of the system, such as those described herein. The electrical track 1004, for some embodiments, is disposed such that the electrical track 1004 electrically couples the stationary electrical contacts 1001 to one or more objects in the bath of a system, such as those described herein.

Figure 11:
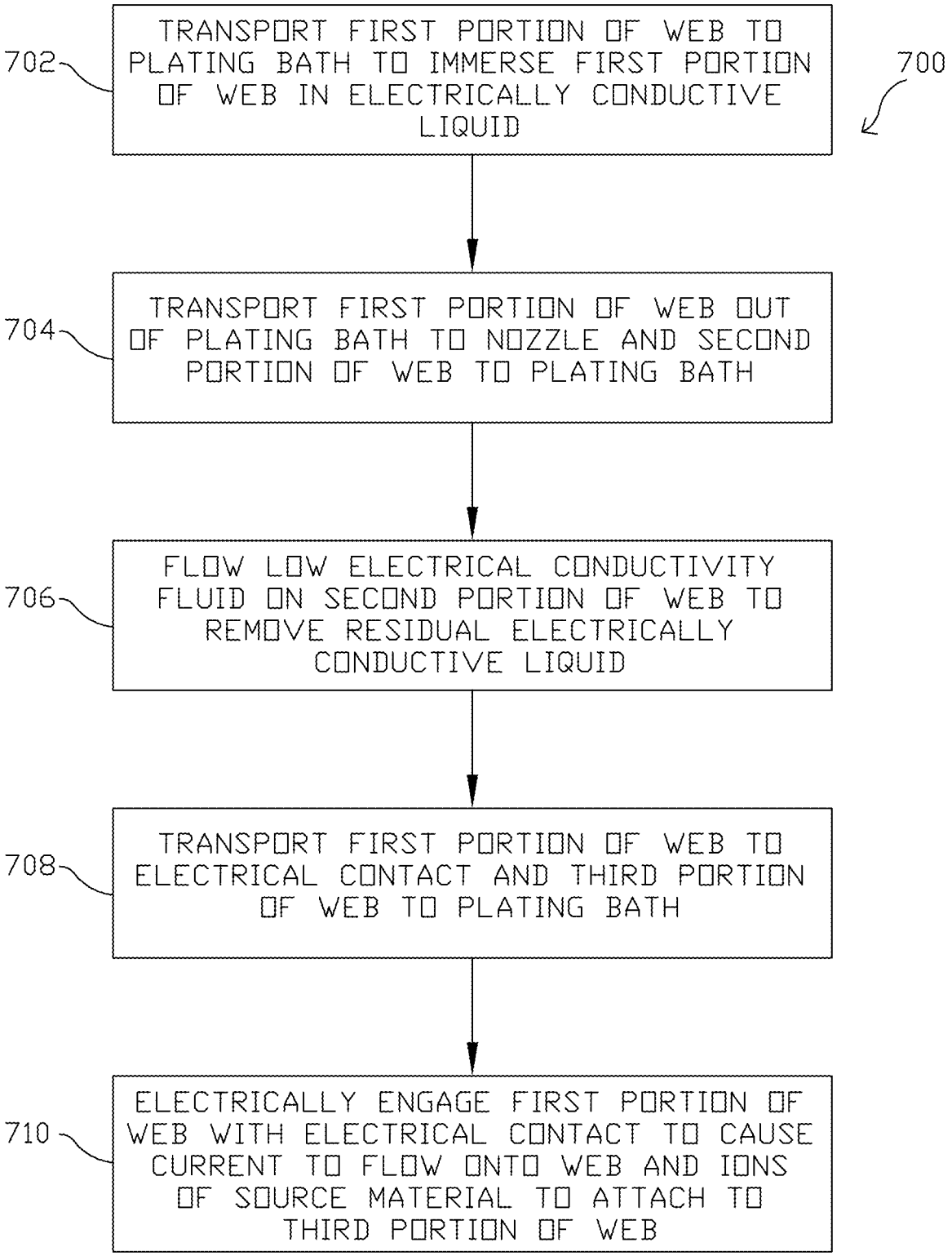
FIG. 11 illustrates a flow chart of a method for electroplating a web of conductive material with ions of a source material according to some implementations of the present disclosure.

A method 700 for electroplating a web of conductive material is illustrated in FIG. 11. At step 702, the web is translated such that the first portion of the web is transported to the plating bath and immersed in the electrically conductive liquid containing ions of the source material. At step 704, the web is translated such that the first portion of the web is transported out of the plating bath to a nozzle, and such that a second portion of the web is transported to the plating bath and immersed in the electrically conductive liquid. At step 706, a low electrical conductivity fluid is flowed or directed onto a surface of the first portion of the web, which removes at least a portion of any residual electrically conductive liquid that remains on the surface of the first portion of the web 101. At step 708, the web is translated such that the first portion of the web is transported to an electrical contact, the second portion of the web is transported out of the plating bath and to the nozzle, and a third portion of the web is transported to the plating bath and immersed in the electrically conductive liquid. At step 710, the electrical contact electrically engages the first portion of the web to cause current to flow into the web. The flowing current causes at least a portion of the ions of the source material in the electrically conductive liquid to attach to a surface of the third portion of the web that is immersed in the electrically conductive liquid.

Figure 12:
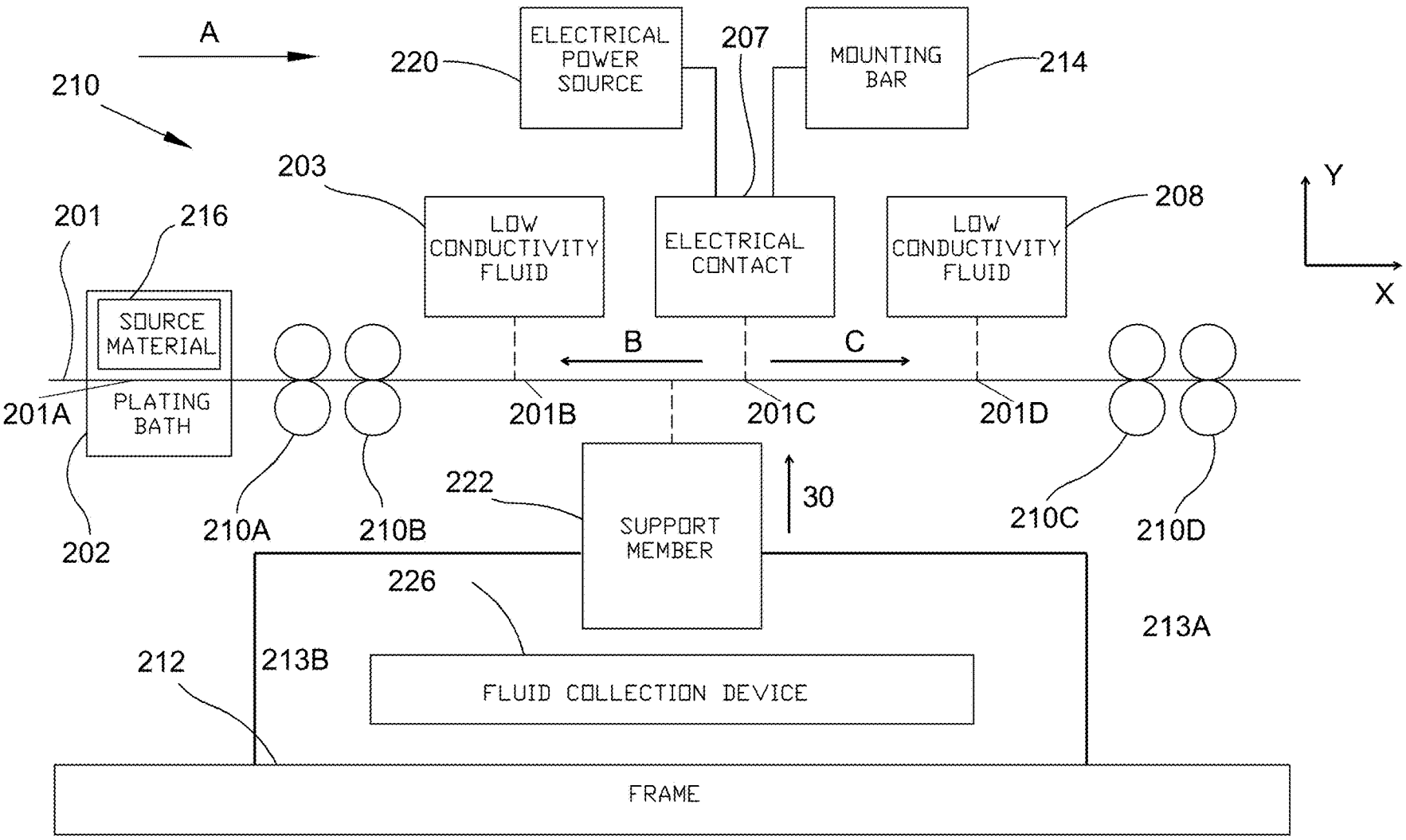
FIG. 12 illustrates a block diagram of a system for electroplating a web of conductive material according to some implementations of the present disclosure.
Figure 13:
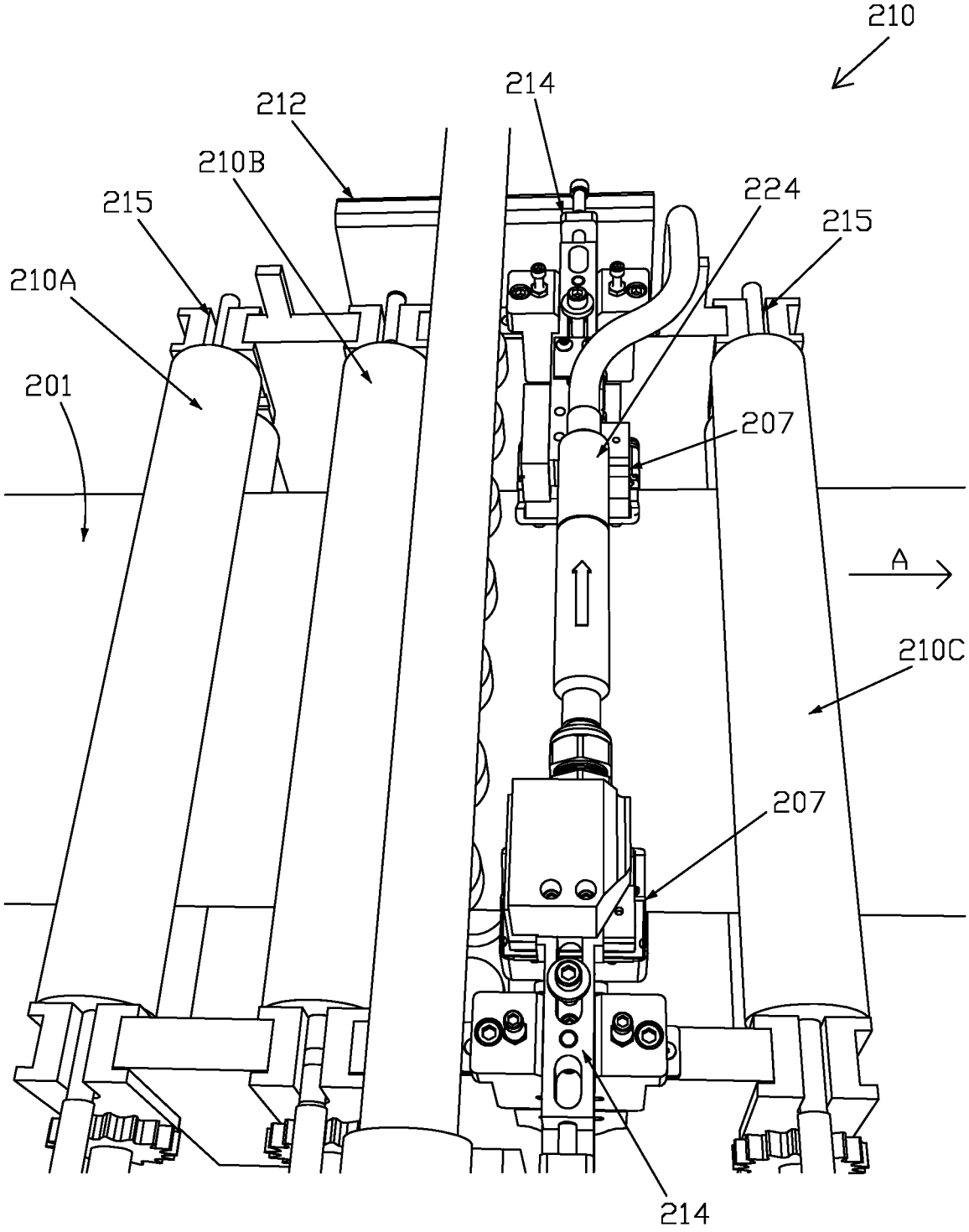
FIG. 13 illustrates a perspective view of an electrical contact according to some implementations of the present disclosure.
Figure 14:
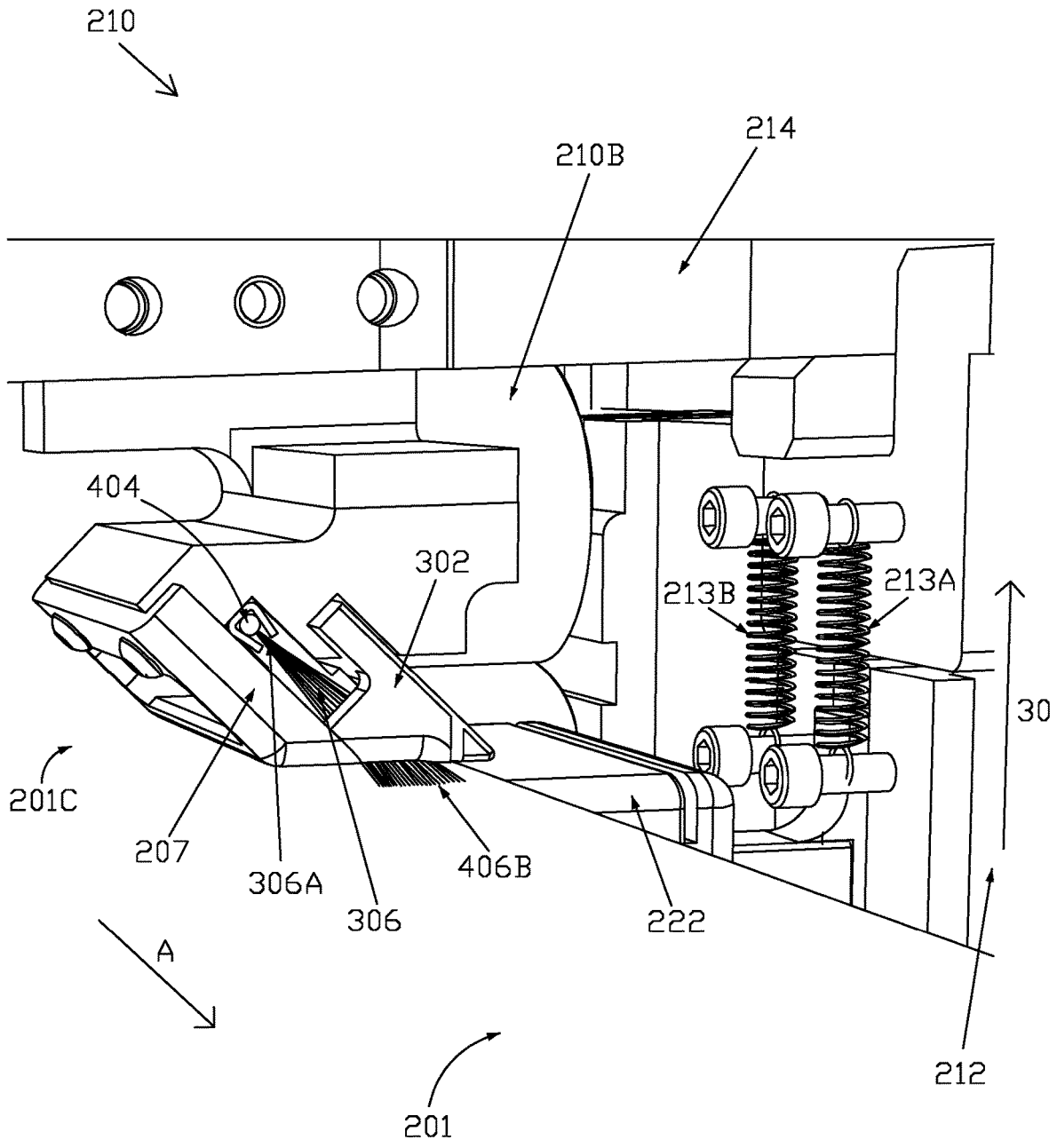
FIG. 14 illustrates a perspective view of an electrical contact according to some implementations of the present disclosure.
Figure 15:
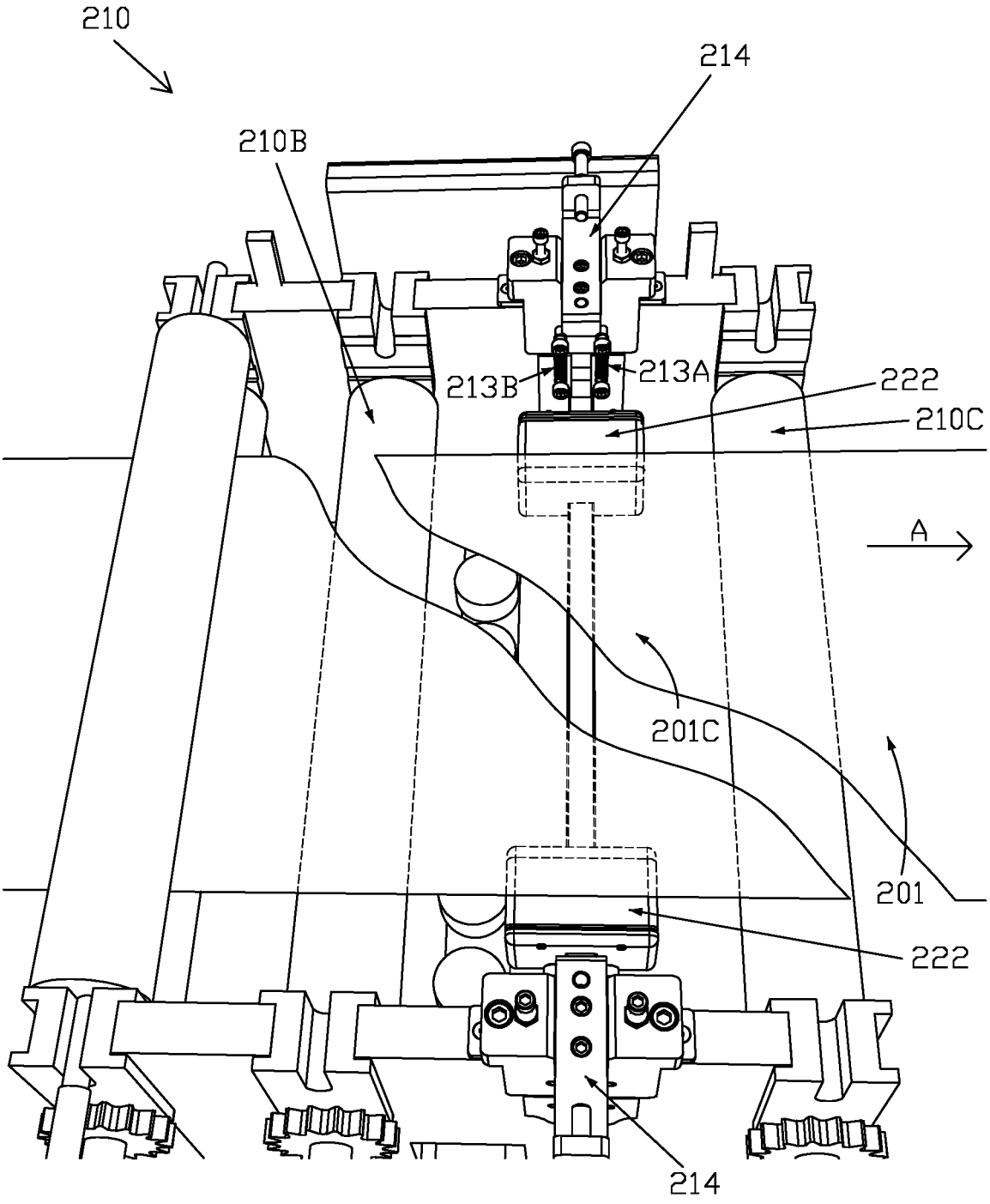
FIG. 15 illustrates a perspective view of an electrical contact according to some implementations of the present disclosure.

FIG. 12 illustrates a block diagram of a system 210 for electroplating a web 201 of conductive material according to some implementations of the present disclosure. FIGS. 13-15 each illustrate a perspective view of an electrical contact of the system 210, according to some implementations of the present disclosure.

The system 210 for plating a web 201 of conductive material includes a plating bath 202 containing a volume of an electrically conductive liquid that include ions to be deposited on an object, a first low electrical conductivity fluid area 203, an electrical contact 207, and a low electrical conductivity fluid area 208.

The system 210 can also include a transport mechanism that includes a first, second, third and fourth transport mechanism portions 210A, 210B, 210C, and 210D that are configured to transport the web 201 through the system 210. The web 201 is transported in the direction of arrow A, which is parallel to the longitudinal axis of the system 210. System 210 can generally be part of a larger overall assembly line that includes a variety of different equipment for performing different tasks on/with an object disposed on web 201 including one or more plating bathes and one or more electrical contacts. The system 210 can be a subset of the overall assembly line where an object disposed on the web 201 is plated.

The system 210 also includes a frame 212 that supports and/or couples to the components of the system 210. For example, each transport mechanism portion 210A-210D can be coupled to slots 215 in the frame 212. Further, electrical contact 207 (which can include electrical contacts 207 as shown in FIG. 13) can be coupled to a mounting bar 214, which is then coupled to the frame 212. The frame 212 can be a single unitary piece or can include multiple separate components that are removably or permanently attached to each other. At various times throughout processing, specific portions of the web 201 are configured to be disposed at or near each component of the system 210.

For example, in some implementations, a first portion 201A of the web 201 is disposed within the plating bath 202 such that the object disposed on the web is at least partially immersed in the electrically conductive liquid, an adjacent second portion 201B of the web 201 is disposed in the first low electrical conductivity fluid area 203, an adjacent third portion 201C of the web 201 is disposed at the electrical contact 207, and an adjacent fourth portion 201D of the web 201 is disposed in the second low electrical conductivity fluid area 208. Thus, in such implementations, the electrical contact 207 is configured to electrically engage the third portion 201C of the web 201 when the first portion 201A of the web 201 is immersed in the electrically conductive liquid of the plating bath 202.

The plating bath 202 contains a volume of an electrically conductive liquid, for example an electrolyte solution containing ions of the material (e.g., copper) that is to be plated onto one or more objects disposed on the web 201. The plating bath 202 also includes the source material 216, which can be, for example, a sample of copper or other metal. The plating bath 202 is configured such that both the source material 216 and any portion of one or more objects disposed on the web 201 are immersed in the electrically conductive liquid of the plating bath 202 or are otherwise in fluid communication with each other via the electrically conductive liquid.

The first transport mechanism portion 210A is disposed between the plating bath 202 and the first low electrical conductivity fluid area 203. The first transport mechanism portion 210A is configured to assist in transporting the web 201 through the system 210. In some implementations, each of the transport mechanism portions 210A-210D includes a top roller and a bottom roller arranged such that when the web 201 is being transported through the system 210, the web 201 is disposed between the top roller and the bottom roller. The top roller and the bottom roller are spaced apart such that the web 201 fits therebetween and both the top roller and the bottom roller contact the web 201. The top roller and the bottom roller generally have a circular cross-section and can have a width extending in the same direction as the width of the web 201. In this manner, the width of the top roller and the bottom roller is perpendicular to the direction of transport (arrow A) of the web 201 through the system 210.

In some implementations, the width of the top roller and the width of the bottom roller are generally equal to the width of the web 201. Thus, the top roller makes contact with the top side of the web 201 in a line extending across the width of the web 201, perpendicular to the direction of transport of the web 201 through the system 210. The bottom roller makes contact with the underside of the web 201 in a line extending across the width of the web 201, perpendicular to the direction of transport of the web 201 through the system 210. In other implementations, the top roller and the bottom roller have varying widths relative to the width of the web 201. The top roller and the bottom roller are each configured to rotate such that friction between the top and bottom rollers and the web 201 causes the web 201 to advance through the system 210 in the direction of arrow A. In this implementation, as a portion of the web 201 emerges from the plating bath 202, some amount of the electrically conductive liquid remains or is otherwise retained on the surface of the portion of the web 201. Because the top roller contacts the surface of the web 201, the top roller comes into contact with at least a portion of the retained amount of the electrically conductive liquid and forces this portion of the electrically conductive liquid off of the surface of the web 201. Thus, the first transport mechanism portion 210A can remove some or all of the retained amount of the electrically conductive liquid from the surface of this portion of the web 201 and the portion of the object disposed on this portion of the web 201. In another implementation, the first transport mechanism portion 210A includes a mechanical gripper or other similar device that is able to physically engage the web 201 and cause the web 201 to advance through the system 210.

The second transport mechanism portion 210B can be disposed adjacent to the first transport mechanism portion 210A such that after a portion of the web 201 emerges from the first transport mechanism portion 210B, that portion of the web 201 then passes between the top roller and the bottom roller of the second transport mechanism portion 210B. The top roller and the bottom roller of the second transport mechanism portion 210B rotate to advance the web 201 through the system 210. The second transport mechanism portion 210B can also assist in removing any residual electrically conductive liquid from the surface of a portion of the web 201 a portion of the object disposed on this portion of the web 201 prior to electrically engaging that portion of the web 201.

After a portion of the web passes through the second transport mechanism portion 210B, that portion of the web is transported through the first low electrical conductivity fluid area 203, which is disposed adjacent to the second transport mechanism portion 210B. As the web 201 passes through the first low electrical conductivity fluid area 203, a low electrical conductivity fluid is sprayed, flowed, directed or otherwise deposited onto the surface of this portion of the web 201 that just emerged from the first transport mechanism portion 210A. The low electrical conductivity fluid that is sprayed onto the surface of the web 201 assists in rinsing off or otherwise removing some or all of residual electrically conductive liquid that may still be disposed on the surface of the web 201 after passing through the first transport mechanism portion 210A. In some implementations, the low electrical conductivity fluid is deionized water. In other implementations, the low electrical conductivity fluid includes, but is not limited to air, reverse osmosis water, alcohols such as isopropyl alcohol, distilled water, and low electrical conductivity fluids.

In some implementations, the first low electrical conductivity fluid area 203 includes one or more nozzles 218 (for example, as shown in FIG. 12) that are in fluid communication with a source of the low electrical conductivity fluid, such as a tank or other storage device. The one or more nozzles 218 can be coupled to the frame 212. According to some implementations, the orientation and/or location of the one or more nozzles 218 are adjustable such that the low electrical conductivity fluid can be sprayed or otherwise emitted from the nozzles 218 and flowed onto any portion of the web 201 along the width of the web 201 that is passing underneath or adjacent to the nozzles 218. The nozzles 218 can be configured to continuously or periodically spray the low electrical conductivity fluid onto the web 201. The nozzles 218 can be positioned at a variety of locations and in a variety of orientations so as to emit the low electrical conductivity fluid at a desired location relative to the electrical contact 207.

The low electrical conductivity fluid being flowed onto the surface of the web 201 has two purposes according to some implementations. The first purpose is to rinse off residual electrically conductive liquid from the surface of the portion of the web 201 and the object disposed on this portion of the web 201 passing underneath the first low electrical conductivity fluid area 203 after that portion of the web 201 passes through the first transport mechanism portion 210A. While the first transport mechanism portion 210A can assist in removing some electrically conductive liquid from the surface of that portion of the web 201, the low electrical conductivity fluid flowed onto the surface of the web 201 removes substantially all of the remaining electrically conductive liquid from that portion of the web 201 so as to greatly decrease the electrical conductivity of any liquid that remains on the surface of that portion of the web 201 and any object disposed thereon. This ensures that when this portion of the web 201 is electrically engaged by the electrical contact 207, electric current flows within the web 201 to the portion of the web 201 that is currently in the plating bath 202. Removal of the electrically conductive liquid helps to ensure the current from the electrical contact 207 flows within the web 201 and not bypassing the web 201 by flowing through the electrically conductive liquid. This ensures that the desired current density is delivered from the electrical contact 207 and to the plating site.

If the surface of the portion of the web 201 that is being electrically engaged by the electrical contact 207 has a sufficient amount of electrical conductive liquid remaining thereon, some amount of the source material 216 that was plated onto the surface of that portion of the web 201 when that portion of the web 201 was in the plating bath 202 can inadvertently be removed from the surface of that portion of the web 201 and be plated onto the electrical contact 207 itself. Removing this inadvertently-plated material from the electrical contact 207 requires additional processing steps, which are often time consuming and inefficient. By flowing low electrical conductivity fluid onto the surface of the portion of the web 201 after that portion exits the plating bath 202 and before that portion is electrically engaged by the electrical contact 207, this "reverse plating" effect can be substantially reduced, or even eliminated. The second purpose of the low electrical conductivity fluid is to cool the surface of the web 201. When the electrical contact 207 electrically engages the web 201, the current being injected can generate a large amount of thermal energy (e.g., heat) in the web 201.

The low electrical conductivity fluid that is flowed into the surface of the web 201 by the first low electrical conductivity fluid area 203 helps to keep the web 201 cool and reduce the amount of heat generated by the contact between the electrical contact 207 and the web 201. Thus, removing the electrically conductive liquid and cooling the web 201 increases the life of the electrical contact 207 minimizing the costs of downtime to maintain the system. After being transported through the first low electrical conductivity area 203, the web is transported to the electrical contact 207. The electrical contact 207 can be coupled to a mounting bar 214, which can then be coupled to the frame 212. In some examples, the electrical contact 207 is coupled to the frame 212 such that the electrical contact 207 is fixed in its position, precluding any movement of the electrical contact 207. The electrical contact 207 may be fixed such that it is unable to move in any degree of freedom when in use. When the electrical contact is not in use, positional adjustments of the electrical contact may be made in the x-y plane and/or in the x-z plane. The x- and y-plane are illustrated herein, the z-plane is understood to be perpendicular to the x- and y-plane, and therefore not feasible to illustrate. The electrical contact 207 is generally disposed above the web and is electrically coupled to an electrical power source 220. The electrical contact 207 is configured to electrically engage the portion of the web 201 that is passing underneath by physically contacting the web 201. This allows current to flow from the electrical contact 207 through at least a portion of the web 201. Generally, the current flows from the electrical contact 207, into the portion of the web 201 that is passing underneath the electrical contact 207, and through the web 201 to at least the portion of the web 201 that is currently immersed in the electrically conductive liquid of the plating bath 202. Because the source material 216 is also immersed in the electrically conductive liquid of the plating bath 202 and electrically coupled to the electrical power source 220, the current flowing through the web 201 causes ions of the source material 216 to attach to the surface of the portion of an object disposed on of the web 201 that is immersed in the electrically conductive liquid.

The electrical contact 207 is designed such the electrical resistance of the path of the current through the electrical contact 207 is generally equal to the electrical resistance of the path of the current through the web 201. By matching these resistances, the amount of resultant current flowing through the web 201 will generally be equal to the amount of current flowing through the electrical contact 207, which can easily be controlled. Thus, by matching the resistance of the electrical contact 207 to the resistance of the current path through the web 201, the amount of source material 216 plated onto the web 201 can be controlled. In some implementations, the electrical resistance of the electrical contact 207 is equal to the electrical resistance of the current path through the web 201. In other implementations, the electrical resistance of the electrical contact 207 is within a sufficient range above or below the electrical resistance of the current path through the web 201. Further, the electrical contact 207 is configured such that the current density across the portion of the web 201 immersed in the electrically conductive liquid is maintained within a range. Thus, the electrical contact 207 minimizes a voltage drop across the portion of the web 201 immersed in the plating bath. For some implementations, the current density at the electrical contact 207 can be in a range including 1 Ampere per centimeter$^2$ up to and including 2100 Amperes per centimeter$^2$. However, other current densities outside this range at the electrical contact 207 can be used.

The electrical contact 207 can be coupled to the frame 212 or the mounting bar 214 using a biasing member, such as a spring. The biasing member is configured to compress responsive to the electrical contact 207 contacting the surface of the web 201. This reduces the downward force that is imparted onto the surface of the web 201 by the electrical contact 207 and causes the electrical contact 207 to be more responsive to variations in the web 201. For example, if the electrical contact 207 encounters any vertical features defined on the surface of the web 201, the biasing member will compress upon contact between the electrical contact 207 and the vertical features, thus reducing the force imparted onto the vertical features and decreasing the chances the features or the electrical contact 207 will be damaged. In addition, the biasing member ensures the electrical contact 207 returns to contact the web 201 for providing the desired current density for plating. Vertical features on the surface of the web 201 may include, but are not limited to, dielectric layers, plating masks, photoresist, drill holes, and plating faults such as extra material plated or other errors in the topology.

As best shown in FIG. 14, the system 210 also includes a support member 222 that is disposed adjacent to the web 201 such that the web 201 is sandwiched between the electrical contact 207 and the support member 222. The support member 222 contacts the underside of the web 201 to provide support and prevent the web 201 from deforming or otherwise bending downward as it passes underneath the electrical contact 207. The support member 222 can be formed from a lubricious or non-stick material (such as Teflon®) to allow the web 201 to easily slide past the support member 222 as it contacts the support member 222. In some implementations, the support member 222 includes a substantially flat surface having a width generally equal to the width of the web 201. In other implementations, the width of the flat surface of support member 222 is larger than the width of the web 201 to allow for the support member 222 to support the web 201 even if the web 201 shifts side to side during processing. The length of the support member 222 (e.g. the dimension of the support member 222 parallel to the direction of transport of the web 201 through the system 210) is generally equal to at least a corresponding dimension of the electrical contact 207. The support member 222 is thus configured to support the underside of the web 201 in an area corresponding to the area of contact between the electrical contact 207 and the top surface of the web 201. In some implementations, all portions of the electrical contact 207 are in equal contact pressure with the web 201. This ensures continuous contact between the electrical contact 207 and the web 201. According to some implementations the support member 222 is one or more rollers. In some implementations, the support member 222 has a width similar to the width of the electrical contact 207.

In some implementations, the support member 222 is a plate that is coupled to the frame 212 by at least one biasing member (e.g., springs 213A, 213B). The spring tension provided by the springs 213A, 213B biases the support member 222 towards the web 201. The springs 213A, 213B biases the support member 222 in direction 30, providing an upward force operable to bring the web 201 in contact with the electric contact 207. For example, if the electrical contact 207 encounters any vertical features defined on the surface of the web 201, the biasing member will expand upon contact between the electrical contact 207 and the vertical features, thus reducing the force imparted onto the vertical features and decreasing the chances the features or the electrical contact 207 will be damaged. In addition, the biasing member ensures the electrical contact 207 returns to contact the web 201 for providing the desired current density for plating.

After a portion of the web 201 is transported past the electrical contact 207, that portion of the web 201 is transported, according to some implementations, through a second low electrical conductivity fluid area 208, which is disposed adjacent to the electrical contact 207. The second low electrical conductivity fluid area 208 can be substantially similar to the first low electrical conductivity fluid area 203, and can include one or more nozzles 224 (for example, as shown in FIG. 13) that are in fluid communication with a source of the low electrical conductivity fluid, such as a tank or other storage device containing the low electrical conductivity fluid. In some implementations, the nozzles 224 of the second low electrical conductivity fluid area 208 may be in fluid communication with the same source of the low electrical conductivity fluid as the first low electrical conductivity fluid area 203. In other implementations, the nozzles 224 of the second low electrical conductivity fluid area 208 are in fluid communication with a separate source of the low electrical conductivity fluid.

The nozzles 224 of the second low electrical conductivity fluid area 208 are configured to flow or direct the low electrical conductivity fluid onto a portion of the surface of the web 201 that has passed by the electrical contact 207. The second low electrical conductivity fluid area 208 also helps to maintain the low electrical conductivity of any liquid disposed on the surface of the web 201 near the electrical contact 207, and also reduces the thermal energy (e.g. heat) generated in the web 201 by the electrical contact 207. Any number of nozzles 224 can be positioned at a variety of locations and in a variety of orientations so as to emit the low electrical conductivity fluid at a desired location relative to the electrical contact 207.

The system 210 can also include a fluid collection device 226. The fluid collection device 226 is generally disposed underneath the web 201 and is configured to collect any fluid that falls off of the web 201 as the web 201 passes through the system 210. For example, the fluid collection device 226 can be an elongated basin that spans the width of the web 201 and is sized to collect any electrically conductive liquid that may be rinsed off the web 201 as the web 201 passes through the first low electrical conductivity fluid area 203 or the second low electrical conductivity fluid area 208. The fluid collection device 226 also collects excess low electrical conductivity fluid that runs off the surface of the web 201. In some implementations, the fluid collection device 226 can recycle the collected low electrical conductivity fluid and return it to the first and second low electrical conductivity fluid areas 203, 208 so that the low electrical conductivity fluid may be used again.

After a portion of the web is transported through the second low electrical conductivity fluid area 208, that portion of the web travels through the third transport mechanism portion 210C and the fourth transport mechanism portion 210D. The third and fourth transport mechanism portions 210C and 210D can similar to the first and second transport mechanism portions 210A and 210B and can each include a top roller and a bottom roller. The top rollers and the bottom rollers contact a respective side of the web, and rotations of the rollers causes the web 201 to advance through the system 210. After a portion of the web 201 exits the fourth transport mechanism portion 210D, that portion of the web 201 can enter a second plating bath (not shown), pass underneath a second electrical contact (not shown), enter into a new subset of the assembly line that that performs a different task on the one or more objects disposed on the web 201, and/or exit the assembly line entirely.

Referring back to FIG. 12, during processing, a first portion 201A of the web 201 is located in the plating bath 202, a second portion 201B of the web 201 is located in the first low electrical conductivity fluid area 203, a third portion 201C of the web 201 is electrically engaged by the electrical contact 207 and is located between the electrical contact 207 and the support member 222, and a fourth portion 201D of the web 201 is located in the second low electrical conductivity fluid area 208. As the electrical contact 207 engages the third portion 201C of the web 201, current is caused to flow from the electrical contact 207 through the web 201. As illustrated by arrow B, current flows from the third portion 201C of the web 201 to the first portion 201A of the web 201 that is disposed in the plating bath 202, causing ions of the source material 216 to attach to the surface of the first portion 201A of the web 201. As shown by arrow C, some amount of current flows in the opposite direction within the web 201 as well.

Other implementations of the system 210 apart from what is illustrated in FIG. 12 are also contemplated. For example, some implementations of the system 210 can exclude the second transport mechanism portion 210B and the third transport mechanism portion 210C such that the electrical contact 207 is disposed directly between the first low electrical conductivity fluid area 203 and the second low electrical conductivity fluid area 208 (e.g., the system 210 can lack the second and third transport mechanism portions 210B and 210C). Other implementations of the system 210 include only one of the first low electrical conductivity fluid area 203 and the second low electrical conductivity fluid area 208, rather than both the first and second low electrical conductivity fluid areas 203, 208. In another implementation, second transport mechanism portion 210B can be located directly adjacent to the first transport mechanism portion 210A such that the first low electrical conductivity fluid area 203 is located between the second transport mechanism portion 210B and the electrical contact 207. The third transport mechanism portion 210C can also be located directly adjacent to the fourth transport mechanism portion 210D such that the first low electrical conductivity fluid area 203 is located between the electrical contact 207 and the third transport mechanism portion 210C.

In some implementations of the system 210, the electrical contact can be a brush contact for electrical plating, such as the electrical contact 302 illustrated in FIG. 14. The electrical contact 302 includes a base 404 and a plurality of bristles 306. The proximal ends 306A of each of the plurality of bristles 306 are coupled to the base 404, while the distal ends 406B of each of the plurality of bristles extends outwardly away from the base 404 and are configured to contact the web 201 to thereby electrically engage the web 201. In some implementations of the disclosure, each of the distal ends 406B of each of the plurality of bristles are in equal contact pressure with the web 201. By using a plurality of bristles 306 that provide multiple distinct current paths between the electrical power source 220 and the web 201, the electrical contact 302 is able to inject current into the web 201 across a broader area. This reduces the chances of damaging or burning the web 201 or the electrical brush contact 302 or having current arc from the contact to the web 201.

In some examples, the electrical contact 302 is coupled to the mounting bar 214, which is secured to the frame 212 such that the electrical contact 302 is fixed in its position, precluding any movement of the electrical contact 302. The electrical contact 302 may be fixed such that it is unable to move in any degree of freedom when in use. When the electrical contact is not in use, positional adjustments of the electrical contact 302 may be made in the x-y plane and/or in the x-z plane.

The base 404 can be coupled to the frame or to the mounting bar such that at least a portion of the bristles 306 are disposed at an angle relative to the web 201. The bristles 306 have varying lengths such that the distal ends 406B of substantially all of the plurality of bristles 306 are coplanar and form or define a plane that is generally parallel to the surface of the web 201. The length of the bristles 306 are thus modified or otherwise configured to form a beveled bottom surface of the electrical contact 302. The bottom surface of the electrical contact 302 can have a generally rectangular shape having major axis parallel to the direction of transport of the web 201 through the system 210, and a minor axis perpendicular to the direction of transport of the web 201 through the system 210. In one implementation, the major axis is about two inches and the minor axis is about one quarter of an inch.

In some implementations, each of the plurality of bristles 306 is formed from substantially pure brass, a brass alloy, stainless steel or another composition including brass. In additional implementations, other electrically conductive metals can also be used, such as copper, zinc, or other suitable materials. The electrical contact 302 can withstand between about 150 amps of current and about 250 amps of current. Thus, in some implementations, the system 210 is configured to cause between about 150 amps of current and between about 250 amps of current to flow through the web 201. In other implementations, the system 210 causes about 200 amps of current to flow through the web 201. In implementations of the system 210 having two or more electrical contacts 302, the system 210 can be configured to cause between about 300 amps of current and about 500 amps of current, or about 400 amps of current, to flow through the web 201. In further implementations of the system 210 having any number of electrical contacts 302, the system 210 can cause less than 150 amps of current to flow through the system 210 as may be desired to plate material having certain characteristic or at a desired plating rate onto the surface of an object disposed on the web 201.

While the present disclosure has been described with reference to one or more particular embodiments or implementations, those skilled in the art will recognize that many changes may be made thereto without departing from the spirit and scope of the present disclosure. Each of these embodiments or implementations and obvious variations thereof is contemplated as falling within the spirit and scope of the present disclosure. It is also contemplated that additional embodiments implementations according to aspects of the present disclosure may combine any number of features from any of the embodiments described herein.

What is claimed is:

1. A system comprising:

a frame;

transport mechanism portions coupled to corresponding slots in the frame and configured to advance a web through the system;

an electrical contact configured to electrically engage the web thereby causing a current to flow from the electrical contact into the web, wherein the electrical contact is comprised of an electrical brush contact and includes a base and a plurality of bristles, each of the plurality of bristles having a proximal end coupled to the base and a distal end configured to electrically engage the web, wherein the electrical brush-contact is coupled to the frame such that each of at least a portion of the plurality of bristles is positioned at an angle relative to the web, and wherein at least a first portion of the plurality of bristles has a first length, and at least a second portion of the plurality of bristles has a second length, the first length being different from the first length such that distal ends of each bristle of the first portion of the plurality of bristles and each bristle of the second portion of the plurality of bristles are coplanar;

a bath configured to contain a volume of an electrically conductive liquid therein, the electrically conductive liquid including a plurality of ions of a source material, the transport mechanism portions configured to transport the web through the bath such that a portion of the web is disposed in the electrically conductive liquid; and at least one nozzle coupled to the frame, the at least one nozzle configured to direct a low electrical conductivity fluid onto a surface of the portion of the web to remove residual electrically conductive liquid disposed on the web.

2. The system of claim 1, wherein each of the plurality of bristles includes brass.

3. The system of claim 1, wherein the electrical brush contact is coupled to the frame such that no movement is allowed.

4. The system of claim 1, wherein each of the plurality of bristles has an electrical resistance and wherein a current path of the current flowing through at least a portion of the web has an electrical resistance, the electrical resistance of each of the plurality of bristles being (i) less than an upper threshold electrical resistance that is greater than the electrical resistance of the current path and (ii) greater than a lower threshold electrical resistance that is less than the electrical resistance of the current path.

5. The system of claim 1, wherein the angle is a compound angle.

6. The system of claim 1, wherein the electrical brush-contact is coupled to the frame such that each of at least a portion of the plurality of bristles is positioned at a first angle relative to an x-z plane and at a second angle relative to a y-z plane.

7. The system of claim 6, wherein a direction of transport of the web is along an x-axis of the x-z plane and the y-z plane.

8. The system of claim 7, wherein the first angle is between about thirty-five degrees and about fifty-five degrees and the second angle is between about fifteen degrees and about thirty-five degrees.

9. The system of claim 1, wherein the angle is between about thirty degrees and about eighty degrees.

10. The system of claim 1, wherein the angle is about forty-five degrees.

11. The system of claim 1, wherein the angle is about twenty-five degrees.

12. The system of claim 1, wherein a plane formed by distal ends of each of the plurality of bristles is generally parallel to the web.

13. The system of claim 1, wherein the plurality of bristles includes a first row of bristles and a second row of bristles, both the first row of bristles and the second row of bristles extending generally parallel to a direction of transport of the web through the system.

14. The system of claim 13, wherein each bristle in the first row of bristles has a first length, and wherein each bristle in the second row of bristles has a second length, the first length being different than the second length such that distal ends of each of the plurality of bristles are coplanar.

15. The system of claim 14, wherein a plane formed by distal ends of each of the plurality of bristles is generally parallel to the web.

16. The system of claim 1, further comprising a support member disposed adjacent the electrical contact such that the web is disposed between the electrical contact and the support member, the support member configured to contact a side of the web opposite the electrical contact.

17. The system of claim 16, wherein the support member is a roller extending generally perpendicular to a direction of transport of the web through the system.

18. The system of claim 16, wherein the support member is a plate extending generally parallel to a direction of transport of the web through the system.

19. The system of claim 18, wherein the support member comprises a plate coupled to the frame by at least one spring, wherein the at least one spring provides a spring tension biasing support member and the web towards the electrical contact.

20. The system of claim 18, wherein the plate includes a lubricious material.

21. The system of claim 1, wherein the transport mechanism portions include a first roller disposed on a first side of the web and a second roller disposed on a second side of the web, the first roller and the second roller configured to have the web disposed between the first roller and the second roller, the first roller and the second roller configured to transport the web in a direction generally of a longitudinal axis of the system.

22. The system of claim 21, wherein the electrical contact is configured to deliver 400 amperes of current to the web.

23. The system of claim 1, wherein the electrical contact is configured to deliver a maximum of 500 amperes of current to the web.

24. The system of claim 1, wherein the electrical contact is configured to deliver between 150 amperes and 250 amperes of current to the web.

25. The system of claim 24, wherein the electrical contact is configured to deliver 200 amperes of current to the web.

26. The system of claim 1, wherein the electrical contact is configured to deliver between 300 amperes and 500 amperes of current to the web.

27. The system of claim 1, wherein the bath is configured as a plating bath.

28. The system of claim 1, wherein the bath is configured as an electropolishing bath.

29. The system of claim 1, wherein the bath is configured as an electroetching bath.

30. The system of claim 1, wherein the electrical brush-contact is configured to be in contact with the web near an edge of the web.

31. A system comprising:

a frame;

transport mechanism portions coupled to corresponding slots in the frame and coupled to frame and configured to transport a web through system;

an electrical contact coupled to the frame and configured to electrically engage the web to cause current to flow from the electrical contact into the web, wherein the electrical contact is comprised of an electrical brush contact and includes a base and a plurality of bristles, each of the plurality of bristles having a proximal end coupled to the base and a distal end configured to electrically engage the web, wherein the electrical brush-contact is coupled to the frame such that each of at least a portion of the plurality of bristles is positioned at an angle relative to the web, and wherein at least a first portion of the plurality of bristles has a first length, and at least a second portion of the plurality of bristles has a second length, the first length being different from the first length such that distal ends of each bristle of the first portion of the plurality of bristles and each bristle of the second portion of the plurality of bristles are coplanar;

a plating bath configured to contain a volume of an electrically conductive liquid including a plurality of ions of a source material, the transport mechanism portions configured to transport the web such that a portion of the web is moved through and in direct contact with the electrically conductive liquid of the plating bath; and at least one nozzle coupled to the frame and configured to direct a low electrical conductivity fluid onto at least a portion of a surface of the web.

* * * * *